US011466704B2

(12) United States Patent
Kurkjian

(10) Patent No.: US 11,466,704 B2
(45) Date of Patent: Oct. 11, 2022

(54) JET PUMP SYSTEM WITH OPTIMIZED PUMP DRIVER AND METHOD OF USING SAME

(71) Applicant: Odessa Pumps and Equipment, Inc., Houston, TX (US)

(72) Inventor: Andrew Loris Kurkjian, Sugar Land, TX (US)

(73) Assignee: Odessa Pumps and Equipment, Inc., Houston, TX (US)

( * ) Notice: Subject to any disclaimer, the term of this patent is extended or adjusted under 35 U.S.C. 154(b) by 709 days.

(21) Appl. No.: 16/013,818

(22) Filed: Jun. 20, 2018

(65) Prior Publication Data

US 2018/0372123 A1 Dec. 27, 2018

Related U.S. Application Data

(60) Provisional application No. 62/524,230, filed on Jun. 23, 2017.

(51) Int. Cl.
*F04F 5/48* (2006.01)
*E21B 43/12* (2006.01)
(Continued)

(52) U.S. Cl.
CPC ..... *F04F 5/48* (2013.01); *E21B 43/124* (2013.01); *F04B 47/04* (2013.01); *F04F 5/10* (2013.01)

(58) Field of Classification Search
CPC ..... F04F 5/46; F04F 5/54; F04F 5/48; F04F 5/10; F04D 15/0066; E21B 43/121; E21B 43/124; E21B 43/129; F04B 47/04
(Continued)

(56) References Cited

U.S. PATENT DOCUMENTS 7,255,175 B2 * 8/2007 Jackson ..... E21B 43/121 166/369
9,103,199 B2 * 8/2015 Lannom ..... E21B 43/121
(Continued)

OTHER PUBLICATIONS

Cunningham R.G. Liquid Jet Pumps for Two-Phase Flows, Journal of Fluids Engineering, vol. 117, (Jun. 1995), pp. 309-316.
(Continued)

*Primary Examiner* — Essama Omgba
*Assistant Examiner* — Christopher J Brunjes
(74) *Attorney, Agent, or Firm* — Jonathan Pierce; Pierre Campanac; Porter Hedges LLP

(57) ABSTRACT

A jet pump system and method facilitate the production of a subterranean fluid. The jet pump system comprises a jet pump, a surface pump, a surface pump gauge, and a pump driver coupled to the surface pump to change a drive frequency of the pump driver based on production parameters and pumping parameters of the surface pump (drive frequency (FR) of the surface pump and the power fluid parameters) whereby the surface pump is selectively varied to optimize production. The jet pump method involves deploying the jet pump into the wellbore; pumping power fluid through the jet pump using the surface pump; measuring the pumping parameters; generating the production parameters of the subterranean fluid produced (production rate (QP) of the subterranean fluid); and optimizing the producing by changing the drive frequency (FR) based on the measured power fluid parameters and the generated production parameters.

25 Claims, 10 Drawing Sheets

(51) Int. Cl.
*F04F 5/10* (2006.01)
*F04B 47/04* (2006.01)

(58) Field of Classification Search
USPC .. 417/46, 47, 76, 84, 88, 89, 184, 108, 163, 417/170, 174; 166/68, 105
See application file for complete search history.

(56) References Cited

U.S. PATENT DOCUMENTS

| | | | | |
|---|---|---|---|---|
| 2009/0167109 | A1* | 7/2009 | Tomita | H04N 5/22521 310/317 |
| 2014/0072452 | A1* | 3/2014 | Tahmassebpur | H01J 37/32513 417/51 |
| 2015/0295403 | A1* | 10/2015 | Lewis, III | H02M 7/44 307/26 |
| 2016/0314225 | A1* | 10/2016 | Gonzales | E21B 41/00 |
| 2017/0363088 | A1* | 12/2017 | Nguyen | F04D 15/0088 |

OTHER PUBLICATIONS

Noronha et al, Improved Two-Phase Model for Hydraulic Jet Pumps, SPE Journal, (Sep. 1998), pp. 227-231.
Noronha et al. Improved Two-Phase Model for Hydraulic Jet Pumps Society of Petroleum Engineers, SPE 37427, (1997), pp. 333-340.
Pump Handbook, 4th ed. The McGraw-Hill Companies, Inc., 1976. pp. 7.3-7.7.
Wikipedia—Hydraulic pumping [retrieved on Jul. 5, 2018], Retrieved from the Internet <http://petrowiki.org/Hydraulic_pumping>.

* cited by examiner

JET PUMP SYSTEM WITH OPTIMIZED PUMP DRIVER AND METHOD OF USING SAME

CROSS-REFERENCE TO RELATED APPLICATION

This application claims the benefit of U.S. Provisional Application No. 62/524,230, which was filed on Jun. 23, 2017, the entire contents of which is hereby incorporated by reference herein.

BACKGROUND

This present disclosure relates generally to wellsite operations. More specifically, the present disclosure relates to artificial lift techniques using pumps, such as jet pumps, for facilitating production at a wellsite.

Wellsite equipment may be used to locate, access, and produce subsurface fluids from subsurface reservoirs. Wellbores are drilled into subsurface formations to reach the subsurface reservoirs. The wellsite equipment may include production equipment positioned in the wellbore to draw the subsurface fluids from the subsurface reservoirs and to the surface for collection. Production rates of fluids flowing to the surface may be measured and/or monitored. Examples of production, measurement, and/or monitoring techniques are described in US Patent/Application Nos. 2016/0312552, 20160356125, 2012/02661976, U.S. Pat. Nos. 6,957,577 and 8,457,897, the entire contents of which are hereby incorporated by reference herein.

The wellsite equipment may also include hydraulic pumping equipment for use with the production equipment. The hydraulic pumping equipment may include a jet pump used for artificial lift as a means to facilitate flow of subsurface fluids from the subsurface reservoirs and to the surface. Examples of artificial lift techniques are described in U.S. Pat. Nos. 5,667,364, 6,873,267, 6,899,188, 7,063,161, 8,444,393, 20120211228, and 20140030117, the entire contents of which are hereby incorporated by reference herein.

Despite advances in production and pumping techniques, there remains a need to optimize production operations.

SUMMARY

The disclosure relates to a jet pump system, comprising: a surface pump; a surface pump; and a pump driver. In at least one aspect, the disclosure relates to a jet pump system for facilitating production of a subterranean fluid from a wellbore at a wellsite. The wellsite has production equipment disposed about the wellbore to produce the subterranean fluid according to production parameters. The jet pump system comprises a jet pump deployed into the wellbore, a surface pump fluidly coupled to the jet pump to pump a power fluid through the jet pump, a surface pump gauge, and a pump driver coupled to the surface pump. The surface pump comprises a pump motor. The measured pumping parameters comprise a drive frequency of the pump motor and power fluid parameters of the power fluid. The power fluid parameters comprise a flow rate of the power fluid. The pump driver comprises sensor inputs and a variable speed drive. The sensor inputs are to receive the production parameters of the produced subterranean fluid. The sensor inputs a coupled to the surface pump gauge to receive the measured pumping parameters. The variable speed drive is coupled to the pump motor of the surface pump to change the drive frequency based on the power fluid parameters and the measured production parameters whereby the surface pump is selectively varied to optimize production.

In another aspect, the disclosure relates to a jet pump system for facilitating production of a subterranean fluid from a wellbore at a wellsite. The wellbore has production tubing disposed therein. The production tubing has a production gauge to measure production rate of the subterranean fluids. The jet pump system comprises a jet pump deployed into the wellbore, a surface pump fluidly coupled to the jet pump to pump a power fluid through the jet pump, a surface pump gauge coupled to the surface pump to measure pumping parameters, and a pump driver. The measured pumping parameters comprise power fluid parameters of the power fluid. The pump driver is coupled to the pump gauge to receive the pump parameters and to the surface pump to change a drive frequency of the surface pump based on the measured pumping parameters whereby pumping of the power fluid into the wellbore is selectively varied to optimize production.

Finally, in another aspect, the disclosure relates to a jet pump method for facilitating production of a subterranean fluid from a wellbore at a wellsite. The jet pump method comprises deploying a jet pump into the wellbore, pumping power fluid through the jet pump using a surface pump, measuring pumping parameters of the surface pump (the measured pumping parameters comprise a drive frequency of the surface pump and power fluid parameters of the power fluid), generating production parameters of the subterranean fluid produced at the surface (the production parameters comprising production rate of the subterranean fluid), and optimizing the producing by changing the drive frequency of the surface pump based on the measured power fluid parameters and the generated production parameters.

BRIEF DESCRIPTION OF THE DRAWINGS

So that the above recited features and advantages can be understood in detail, a more particular description, briefly summarized above, may be had by reference to the embodiments thereof that are illustrated in the appended drawings. It is to be noted, however, that the examples illustrated are not to be considered limiting of its scope. The figures are not necessarily to scale and certain features and certain views of the figures may be shown exaggerated in scale or in schematic in the interest of clarity and conciseness.

FIGS. 5A, 5B, 5C1, 5C2, and 5D are graphs depicting examples of stability of flow of various fluids at the wellsite.

DETAILED DESCRIPTION

The description that follows includes exemplary apparatus, methods, techniques, and/or instruction sequences that embody techniques of the present subject matter. However, it is understood that the described embodiments may be practiced without these specific details.

Introduction

The present disclosure relates to a jet pump system and method for use with production equipment at a wellsite to facilitate production of subsurface fluids (i.e., artificial lift). The jet pump system includes a jet pump, a surface pump, and a pump driver to selectively pump power fluid into the wellbore. The power fluid mixes with the subsurface fluids to facilitate production of the fluids through the production equipment.

The pump driver defines an optimum drive frequency (FR) for driving the surface pump to flow the power fluid through the jet pump and into the wellbore. The optimum drive frequency (FR) may be selected to minimize pump intake pressure (PIP) (e.g., pressure of fluid produced from the reservoir into the downhole production equipment and/or flowing pressure of the subsurface fluids through the wellbore) and/or to maximize liquid production rate (Q2) (e.g., liquid production rate and/or the flow rate of subsurface fluids into the downhole production equipment). The drive frequency (FR) may be defined based on wellsite parameters, such as production parameters (e.g., liquid production rate (Q2)), pumping parameters (e.g., flow rate (Qpf), pressure (Ppf) of the power fluid, jet pressure (P0), PIP (P2)), equipment parameters (e.g., nozzle area (An), nozzle measured depth (L), nozzle true vertical depth (D), etc.), operating parameters (e.g., stability period (PS)) and/or other data, and/or a known inflow performance relationship (IPR) (if available).

The IPR as used herein refers to a relationship between the liquid production rate (Q2) and the PIP (P2). This relationship describes pressure-rate behavior of the wellbore, and may be based on, for example, a static pressure at the downhole pump and a defined productivity index of the wellbore. The IPR may be graphically depicted as a curve generated from a plot of PIP (P2) versus liquid production rate (Q2) as is described further herein.

The jet pump system and methods herein may provide one or more of the following: real time or over time measurement of surface pumping pressures, real time or over time measurement of pumped power fluid flow rate; real time or over time measurement of produced fluid flow rates (e.g., flow meter for produced fluids and/or phases); real time and/or selective control of the surface pump and/or jet pump; optimization based on pumping and/or production parameters; optimization whether or not IPR is known, etc.

Artificial Lift

Figure 1A:
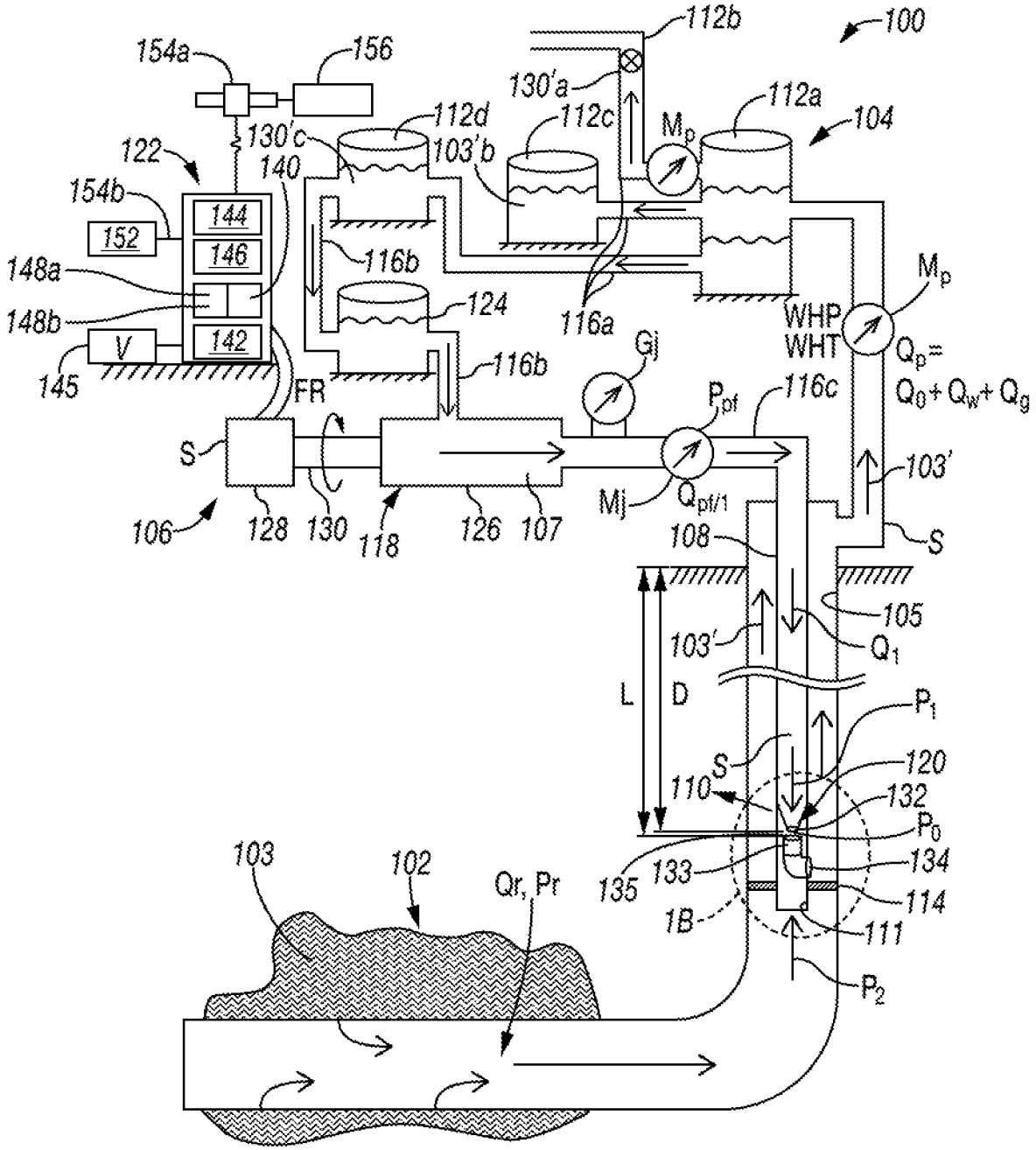
FIG. 1A is a schematic diagram, partially in cross-section of a wellsite having production equipment for producing subsurface fluids from a subsurface reservoir, and a jet pump system including a jet pump for facilitating the producing.

FIG. 1A depicts an example wellsite 100 used in producing subsurface fluid 103 from a subsurface reservoir 102. The wellsite 100 includes production equipment 104 used to separate the subsurface fluid 103 at the surface through a cased wellbore 105, and pumping equipment 106 used to facilitate flow of the subsurface fluid 103 to the surface by pumping a power fluid 107 into the wellbore 105. The subsurface fluid 103 may be a mixture of fluids, such as oil gas, water. The power fluid 107 may be water, oil, additives, and/or other fluids that may mix with the subsurface fluid 103 to facilitate production thereof.

The production equipment 104 includes production tubing 108, a bottom hole assembly 110, and surface collectors/distributors 112*a-d*. The bottomhole assembly 110 is deployed into the cased wellbore 105 by the production tubing 108. The bottomhole assembly 110 has an intake 111 at a downhole end to receive the subsurface fluid 103 therein. The production tubing 108 is supported in the cased wellbore 105 by a packer 114. The packer 114 fluidly separates an upper portion of the wellbore 105 from a lower portion of the wellbore 105. The production tubing 108 is fluidly connected to the collectors/distributors 112*a-d* via flowlines 116*a*.

The subsurface fluid 103 from the reservoir 102 passes through the wellbore 105 and into the tubing 108 where it mixes with the power fluid 107 to form a produced fluid 103'. The produced fluid 103' passes through the wellbore 105 and into the collectors/distributors 112*a-d* via the flowlines 116*a*. The produced fluid 103 initially passes into tank 112*a* for separation. The tank 112*a* may be a well test or permanent separator used to suspend the produced fluid 103' for a period of time until components of the produced fluid 103' separate into phases, such as gas 103'*a*, oil 103'*b*, and water 103'*c*. The tank 112*a* may be or include a centrifuge or other mechanisms for separation.

The phases 103'*a-c* may be passed from the tank 112*a* via the flowlines 116*a* for distribution. As shown, gas 103'*a* passes from tank 112*a* to a gas pipeline 112*b*, oil 103'*b* passes from tank 112*a* to tank 112*c*, and water 103'*c* passes from tank 112*a* to tank 112*d*. The oil in tank 112*c* may pass to an oil truck or pipeline for subsequent sale. Some of the water from the water tank 112*d* may be transferred either to a power fluid tank 124 and/or to a truck (or pipeline) for disposal or reinjection in the reservoir 102 or some other reservoir.

In at least some cases, the pressure of the subsurface fluid 103 may be insufficient to flow the subsurface fluid from the reservoir and/or to the surface, and/or for desired liquid production rates (Q2). The pumping equipment 106 may be provided at the wellsite 100 to alter fluid parameters, such as pressure, flow rate, composition, and/or viscosity, and generate the produced fluid 103' used to facilitate flow to the surface.

The pumping equipment 106 includes a surface pump 118, a hydraulic downhole pump (e.g., jet pump) 120, a pump driver 122, and the pump tank 124. The surface pump 118 may be a hydraulic pump coupled to the pump tank 124 via flowline 116*b* to receive the power fluid 107 therefrom. The pump tank 124 may be a tank filled with the power fluid 107. Optionally, the pump tank 124 may be coupled to the water tank 112*d* via another flowline 116*b* to receive the produced water 103'*c* separated from the produced fluid 103' for use as the power fluid 107. Other fluids and/or additives may be provided.

The surface pump 118 may be, for example, a hydraulic pump (e.g., centrifugal pump, positive displacement pump, etc.) coupled to the pump tank 124 to receive the power fluid 107 therefrom. The surface pump may be used to pass the power fluid 107 from the pump tank 124 through the jet pump 120 and into the wellbore 105. Examples of surface pumps that may be used include a motor driven centrifugal pump commercially available from GE OIL AND GAS CORPORATION™ at http://www.hydrocarbons-technology.com/contractors/pumps/ge-hydrocarbons/.

The surface pump 118 may include a pumper 126, a motor 128, and a shaft 130. The motor 128 may be a hydraulic, electric or other motor capable advancing the power fluid 107 from the pumper 126 to the jet pump 120. The motor 128 may be, for example, an electric motor with the rotating shaft 130 to rotationally operate the pumper 126. The pumper 126 may be fluidly coupled to the jet pump 120 via a flowline 116*c* to pass the power fluid 107 through the jet pump 120.

As shown in FIGS. 1A and 1E, the jet pump 120 is deployed into the wellbore 105 via the flowline 116*c* to pass the power fluid 107 into the wellbore 105. Examples of jet pumps that may be used are commercially available from JJ TECH™ at http://www.hydrocarbons-technology.com/contractors/pumps/ge-hydrocarbons/. In the example shown, the jet pump 120 includes a nozzle 132, a throat 133, an exit port 134, and a diffuser 135 positioned about the production tubing 108. The production tubing 108 may be integral with or coupled to the flowline 116*c* for fluid communication with the surface pump 118. The nozzle 132 may be positioned at a downhole end of the production tubing 108 to decrease pressure of the power fluid (P1) passing therethrough. The diffuser 135 may be positioned after the throat 133 to reduce velocity and/or increase pressure of the fluid 103 and power fluid 107 which may be mixed in the throat 133.

The exit port 134 may be in fluid communication with the wellbore 105 to pass the mixture of the power fluid 107 with the subsurface fluid 103 into the wellbore 105 at pressure $P_E$. The intake 111 may be at a downhole end of the packer 114 in hydraulic communication with the reservoir to receive the subsurface fluid 103 from the reservoir 102. The power fluid 107 exiting the exit port 134 mixes with the subsurface fluid 103 in the bottomhole assembly 110 as it flows into the wellbore 105 at the intake liquid production rate (Q2) and gas flow rate (Qg2). When the PIP (P2) is lowered, the reservoir 102 may produce more of the subsurface fluid 103. The power fluid 107 pressure (Ppf) and flow rate (Qpf) may be altered to alter the intake pressure (P2) of the subsurface fluid 103 as it is produced. The power fluid 107 has a pressure (P1) as it enters the jet pump 120 through the production tubing 108, which decreases to jet pressure (P0) at the nozzle exit 132. The tubing 108 has a diameter (Dt). The nozzle 132 is located at a true depth (D) below the surface and at tubing length (L). The nozzle 132 defines a reduced flow area (An) to decrease the power fluid 107 pressure (P1), and the throat 133 has an area (At).

Figure 1B:
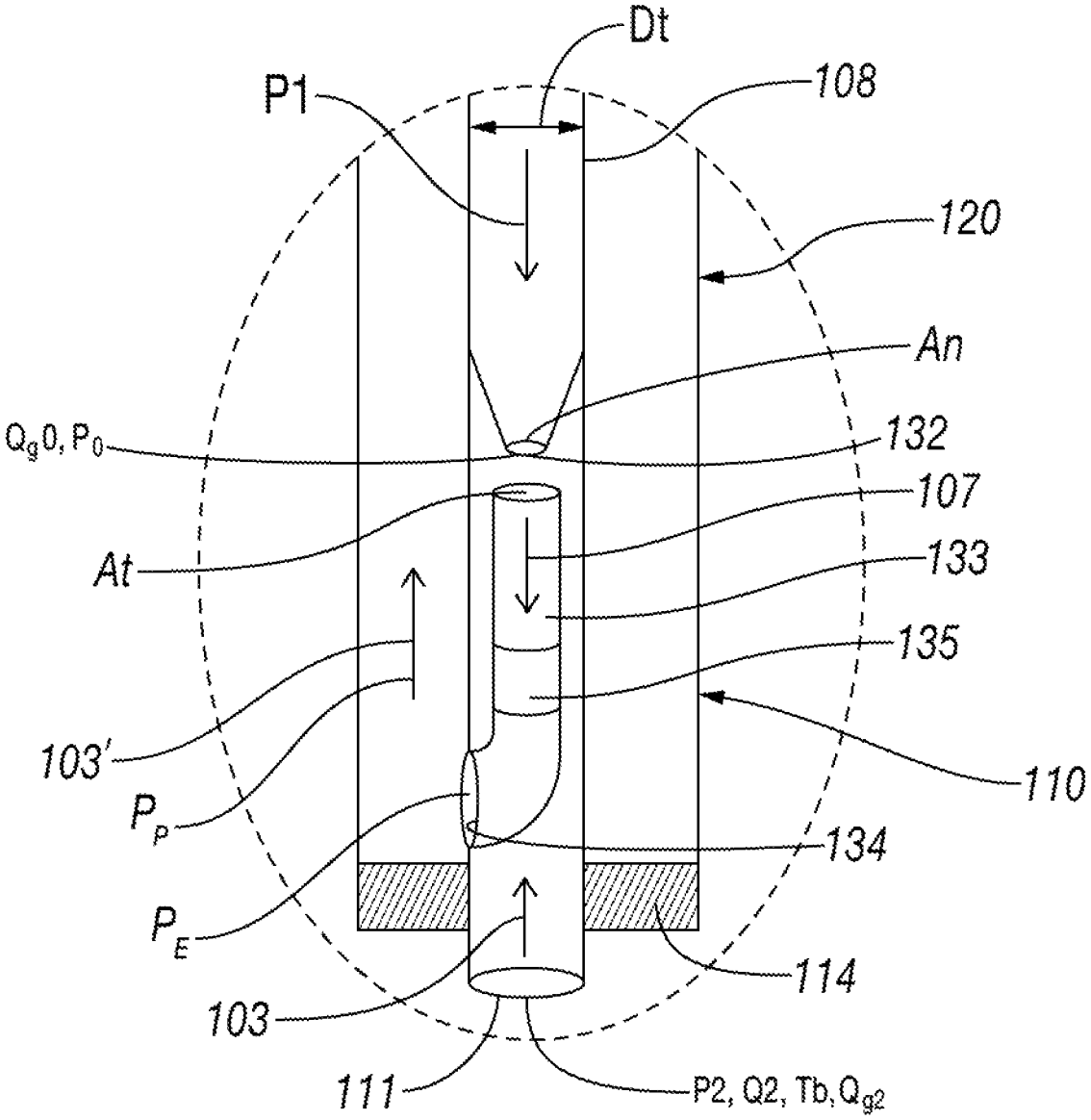
FIG. 1B is a schematic view of a portion 1B of the jet pump system of FIG. 1A depicting a portion of the jet pump.

The intake pressure PIP (P2) of the subsurface fluid 103 at intake 111 increases to a production pressure (PP) as the power fluid 107 mixes with the subsurface fluid 103. The power fluid 107 may mix with the subsurface fluid 103 to facilitate flow of the mixed subsurface/power fluid 103' produced through the wellbore 105 and into the surface collectors distributors 112*a-d*. This produced fluid 103' may have altered fluid parameters (e.g., viscosity, pressure, temperature, etc.) from the subsurface fluid 103 at the reservoir 102. Other parameters may be known or determined as shown in FIG. 1B.

The pump driver 122 may include a variable speed (or frequency) drive 140 and a power supply 142. The variable speed drive 140 may be coupled to the motor 128 for changing rotation of the shaft 130, thereby changing the flow of the power fluid 107 from the pumper 126, through the jet pump 120 and into the wellbore 105. This changing of the flow of the power fluid 107 may alter the pressure (P2) of the subsurface fluid 103 as it passes into the intake 111, and of the composition of the mixture of the power fluid 107 with the subsurface fluid 103 as it is produced, thereby changing flow of the produced fluid 103' at the surface. The subsurface fluid 103 has at pressure PR, flow rate QR, and temperature Tb at the intake 111.

The variable speed drive 140 may be an electrical-mechanical drive system coupled to the power supply 142 to receive power therefrom, and may be used to selectively change the power to the pump motor 128, thereby changing flow of the power fluid 107. The variable speed drive 140 may be capable of controlling motor parameters, such as motor speed (Sm) and/or torque (Tm), of the pump motor 128. The variable speed drive 140 may be, for example, an electrical power supply for receiving voltage from a power supply (or source) 145 and for providing power to the pump driver 122. The variable speed drive 140 may also be used to change motor parameters, such as frequency (FR) and/or voltage (V), to the surface motor 128, thereby altering pumping rate (Qpf) of the power fluid 107 passing into the jet pump 120.

The variable speed drive 140 may have various electronics, such as a rectifier 148*a* and inverter 148*b* to convert the power (e.g., voltage) from the power supply 145 into a format for use by the pump motor 128. For example, the rectifier 148*a* may convert AC power at the supply 145 frequency to a constant DC voltage, and the inverter 148*b* may be used to convert the DC voltage to a desired AC frequency. One or more converters may be used to convert the power as needed to operate the variable speed drive 140 and/or the pump motor 128.

The pump driver 122 may also include various drive components, such as a sensor input 144, a communicator 146, and a processing unit 152. The sensor input 144 may be coupled to sensors S, gauges Gj, meters Mj, Mp, and/or other monitoring (e.g., measurement) devices positioned about the wellsite 100 that are capable of collecting data. The sensor input 144 may include or be coupled to databases coupled to the monitoring devices to receive data (e.g., measurements) therefrom as schematically shown by the dotted line.

The sensor input 144 may collect and combine a variety of measurements from various sensors, gauges, meters, and/or other sources. For example, gauge Gj may be a pressure gauge used to measure pressure (Ppf) and meter Mj may be a flow, turbine or other meter used to measure flow rate (Q1=Qpf) of the power fluid 107 pumped by the surface pump 118 to the jet pump 120. In another example, meter (Mp) may be a flow meter coupled to one or more of the surface collectors/distributors 112*a-d* (e.g., along flowline 116*a*) to measure the liquid production rate (QP=Qo+Qg+Qw) of the produced fluid 103' produced from the wellbore 105. Optionally, data may be received from sensors S positioned about the wellsite as schematically shown and/or from other sources, such as external inputs, historical data, user/operator inputs, etc.

The communicator 146 may be a transceiver, antenna, wired and/or wireless connection, and/or other device capable of sending and/or receiving communication signals. The communicator 146 may be used to connect to various devices on or offsite. For example, the communicator 146 may be coupled via an offsite link (e.g., a satellite or wireless connection) 154*a* to offsite facilities 156, and/or via an onsite link (e.g., a cable or wireless connection) 154*b* to the processing unit 152. The communicator 146 may include, for example, and input/output devices, such as keyboards, mice, displays, to allow users to interact with the pump driver 122. The communicator 146 may also be coupled to or integral with the sensor input 144 to communicate data and/or measurements to components within the pump driver 122, at the wellsite 100, and/or offsite.

The processing unit 152 may be a central processing unit (CPU), computer, and/or other device capable of processing (e.g., combining, analyzing, evaluating, sorting, translating, and/or otherwise manipulating) the measurements and/or data received by the sensor input 144 and/or the communicator 146. For example, the processing unit 152 may be capable of collecting, determining, and/or generating pumping, production, operating, and/or other wellsite parameters of the wellsite.

The processing unit 152 may also include a controller capable of making decisions and/or sending signals to the pump 118 and/or other equipment at the wellsite 100 in response to the data and/or measurements before and/or after processing. The controller of the processing unit 152 may be used to selectively change operation of the variable speed driver 140 based on user inputs received from the communicator 146, data received from the sensor input 144, processed data from the processing unit 152, and/or other devices. The processing unit 152 may be coupled to the variable speed driver 140 to control operation of the surface pump 118 and/or jet pump 120 by selectively changing drive frequency (DF=FR) of the pump motor 128. Such control may be based on various of the data inputs and/or the wellsite parameters generated therefrom as is described further herein.

Optimizing Production

Figure 2A:
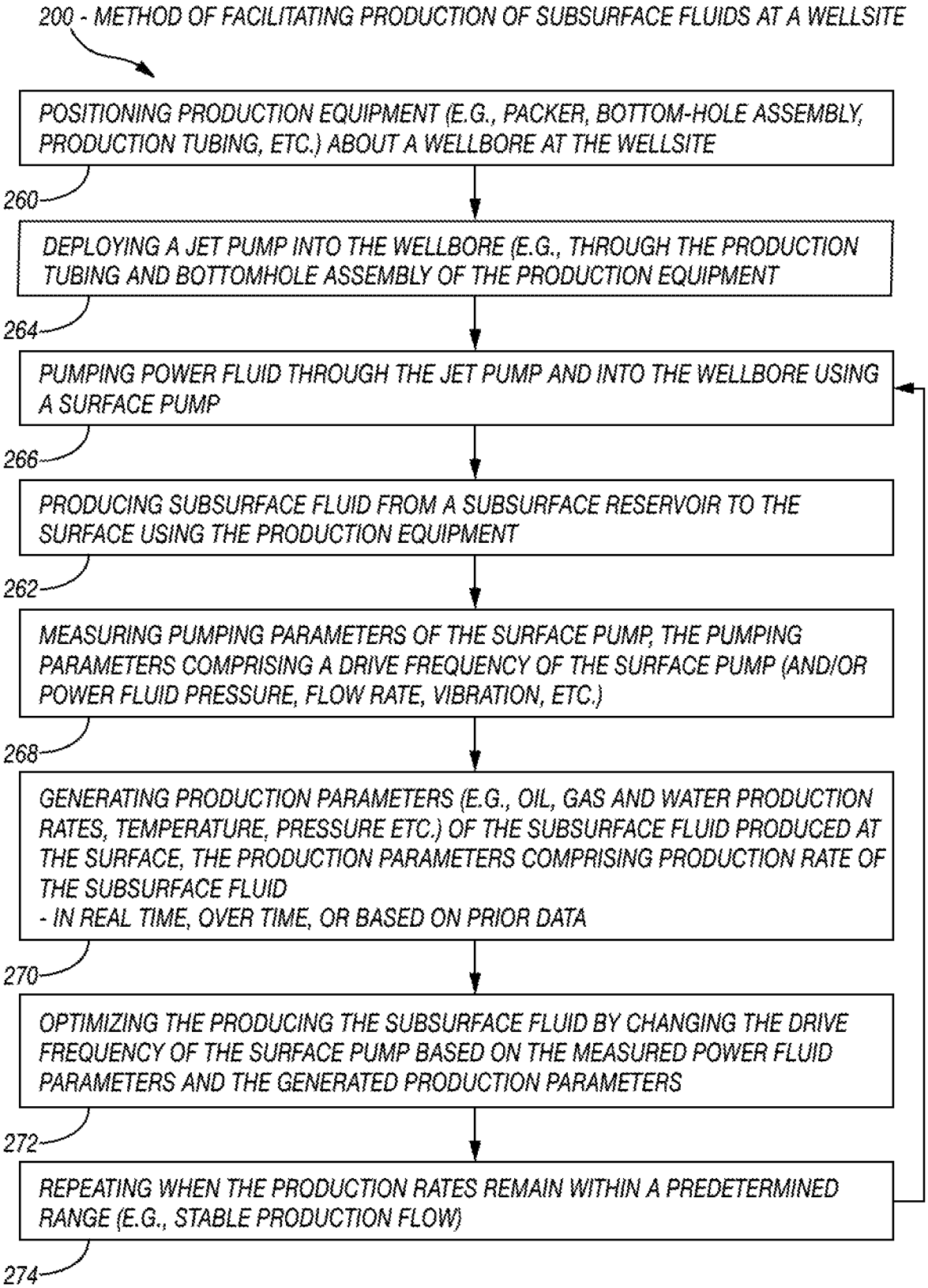
FIG. 2A is a flow chart depicting a method of facilitating production of the subsurface fluids at a wellsite.

FIG. 2A depicts a method 200 of facilitating production of subsurface fluids at a wellsite, such as the wellsite of FIGS. 1A and 1B. The method 200 may involve 260—positioning production equipment about a wellbore at the wellsite. The production equipment may include, for example, a packer, a bottom-hole assembly, production tubing, etc. as shown in FIG. 1A. The method may also involve 264—deploying a jet pump into the wellbore, 266—pumping power fluid through the jet pump and into the wellbore using a surface pump, and 262—producing subsurface fluid from a subsurface reservoir, to the surface using the production equipment. The jet pump may be deployed through the production tubing and bottomhole assembly of the production equipment as shown in FIGS. 1A and 1B.

The method 200 also involves 268—measuring pumping parameters of the surface pump, and 270—generating production parameters of the subsurface fluid produced at the surface. The pumping parameters may include, for example, drive frequency (FR) of the surface pump, power fluid pressure (Ppf) flow rate (Qpf=Q1), motor vibration, etc. The production parameters may include, for example, liquid production rate (QP), temperatures, pressures, etc. of the produced fluid 103'. The generating may be done in real time, over time, and/or based on prior data. The generating may also involve measuring, gathering, collecting, and/or otherwise acquiring. Additional data may also be used.

The method also involves 272—optimizing the producing by changing the drive frequency (FR) of the surface pump based on the measured power fluid parameters and the generated production parameters. The method may also involve repeating 266-272 when the production rate (Q2) remains within a predetermined range (e.g., stable production flow).

Figure 2B:
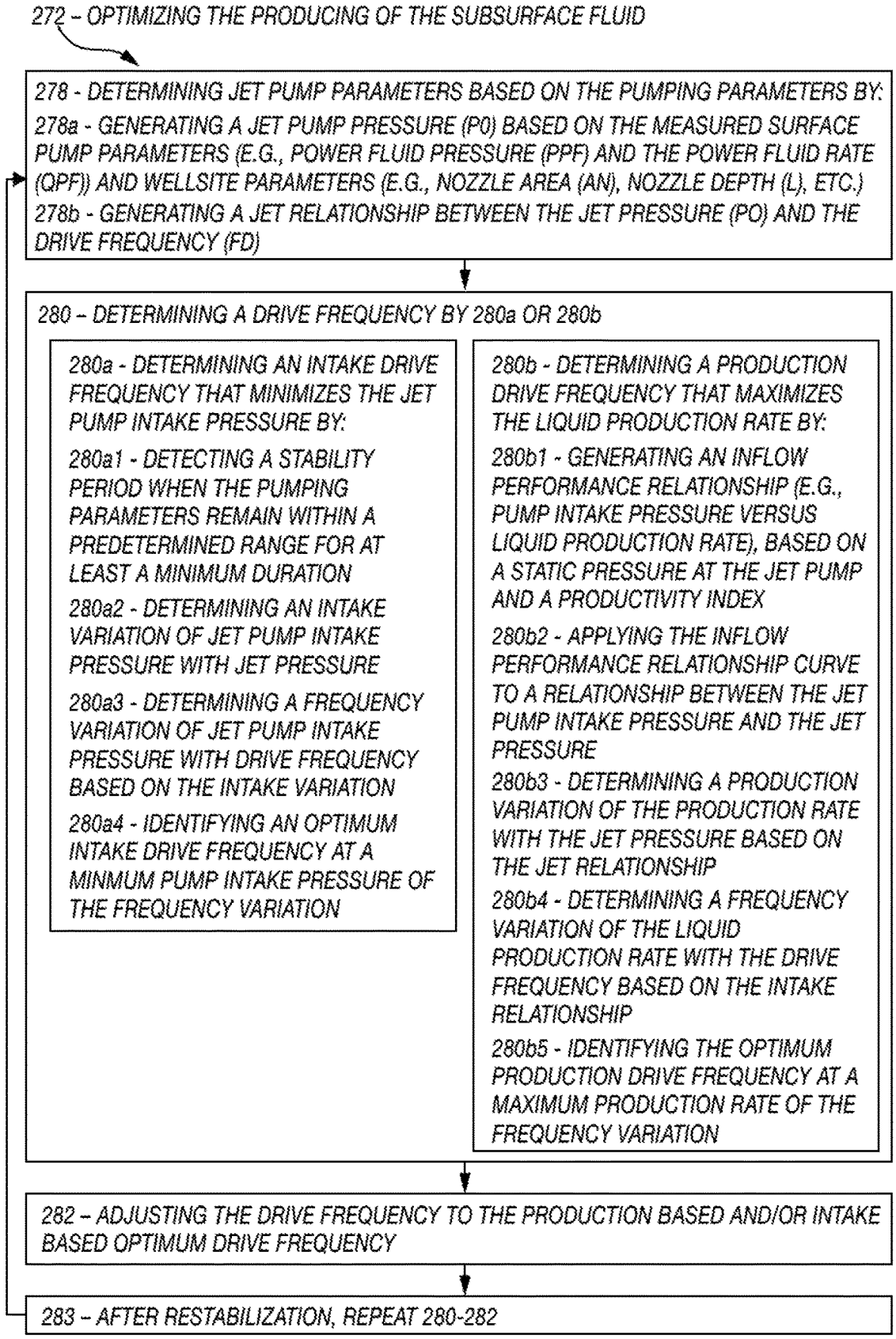
FIG. 2B is a flow chart depicting a portion of the method of FIG. 2A including optimizing the producing the subsurface fluid.

FIG. 2B depicts a portion of the method 200 of FIG. 2A relating to the optimizing (272) the producing the subsurface fluid. The optimizing 272 involves changing the drive frequency (FR) of the surface pump based on the measured power fluid parameters and the production parameters. An example of the optimizing (272) is depicted by the graphs of FIGS. 3A-6D7B as is described further herein.

The 272 optimizing involves 278—determining the jet pump parameters based on the pumping parameters and 280—determining a drive frequency. The 280—determining a drive frequency (FR) may be performed using either a minimized pump intake pressure (280*a*) and/or a maximized liquid production rate (280*b*). The determining (280*a*) for minimum pump intake pressure (P2) may be performed when the IPR is not available, and production rate of oil (Qo), water (Qw) and gas (Qg) is available. The determining 280*b* for maximum liquid production rate (Q2) may be performed when the IPR is available, but the production rate of oil (Qo), water (Qw) and gas (Qg) may not be available.

Referring to FIGS. 1A, 1B and 2A, the method 200 and/or optimizing 272 may be performed based on an understanding of flow behavior at the wellsite 100. In particular, the flow behavior using the production and pumping equipment of FIGS. 1A and 1B may be based on a combination of pressure-volume-temperature (PVT) equations governing behavior of the produced fluid 103', flow equations based on the equipment configuration of the jet pump 120 (e.g., the nozzle 132, intake 111, throat 133, and diffuser 135), and an IPR equation governing the reservoir. The PVT behavior of fluid in the wellbore may be determined by examining the PVT behavior of the three phases (e.g., gas, oil, water). The PVT equations describe how volume (i.e. flow rate Q) and density (ρ) change as a function of pressure (P) and temperature (T).

The PVT behavior may be described by correlations between surface and downhole fluid parameters. Fluid parameters, such as flow rates and densities of the produced oil, water and gas on the surface, may be different than those downhole, where the pressure and temperature is higher. For example, the oil rate (Qo) downhole may be higher than at the surface because gas dissolves into the oil when pressure and temperature increase. In another example, the gas rate (Qg) downhole may be smaller than at the surface because gas compresses with pressure. The gas density (ρg) may increase downhole as it compresses with pressure. Gas rate (Qg) and density (ρg) may be more temperature dependent than oil or water.

The surface pump 118 has a power fluid pressure (Ppf) at the flowline 116*c* which varies the pressure (P2) of the subsurface fluid 103 at the intake 111 as it passes through the jet pump 120. The power fluid 107 flows from the surface pump 118 at a power fluid pressure (Ppf), and passes down the tubing 108 and into the jet pump 120 at pressure P1. The pressure drops from the power fluid pressure (P1) as fluid passes through the nozzle 132 resulting to a jet pressure (P0). The amount of the drop depends on fluid parameters, such as flow rate (Q1=Qpf) pressure (P1), nozzle area (An) and the density, of the power fluid 107. The fluid continues through the throat (or mixing tube) 133 and a diffuser 135.

At least some of the parameters may be measured. For example, the pumping parameters may be measured by the gauge Gj and meter Mj at the surface, the density of the power fluid (e.g., water) may be measured by weight, and the depth of the jet pump may be measured by true vertical depth (D) and measured depth (L). From these measurements, other parameters may be extracted as is described further herein.

For example, the pressure at the entrance to the nozzle (P1) can be calculated. Based on known fluid parameters, such as power fluid rate (Qpf), the nozzle area (An), and the pressure (P1), other parameters may be determined, such as the jet pressure (P0) on a downstream side of the nozzle 132.

With this information, certain parameters, such as the pressure (P0), may not require any knowledge of the reservoir parameters, such as produced fluid flow rate (Q2 comprised of Qo, Qw and Qg) or pressure (Pr=P2=PIP)).

Production parameters may be available from third party sources, or from available measurements. For example, operating companies may measure barrels of oil and water accumulated in a 24-hour day in stock tank barrels, and gas in standard cubic feet (meters). Measurements may be taken before or after separation into phases 103'*a-c* in separator 122*a*. For example, production rate (Q2 comprised of Qo, Qw and Qg) may be measured at the meter Mp before separation in tank 112*a*. The production rate (e.g., Qg, Qo, Qw) may also be measured by a meter Mj for each of the phases after separation, or using a level within each collector/distributor 112*b-d*. The gas flow rate (Qg) at meter Mp may be converted to standard pressure and temperature.

The bottomhole temperature (Tb) and the temperature of the fluid at the intake 111 may be known for a given area. The jet pressure (P0) can be calculated from the pressure Ppf and Qpf=Q1. From the surface daily production flow rates (Qg, Qo, Qw) and the densities (ρg, ρo, ρw) of the three phases may be known pressure and temperature. The PIP (P2) may be determined based on a pressure drop in the subsurface fluid 103 from the intake 111 to the jet exit 134 where the subsurface fluids 103 and the power fluid 107 meet and both enter the throat 133.

Similar to the flow through the nozzle 132, the pressure drop at the intake 111 may depend on the flow rate of liquid (Q2) and gas (Qg2) and the area (Ar). The area (Ar) is the difference between the throat area (Ar) and the nozzle area (An). It may be assumed that the flow rate (Qo, Qw) and density (ρo, ρw) of the oil and water at the intake 111 may be the same as at the jet exit 134 as they are at the jet intake, 111. This assumption may be based on the fact that the oil and water of the subsurface fluid 103 are in the liquid phase, and there is no time for gas to release from the liquids, or for gas to enter the liquids.

The gas flow rate (Qg2) and density (□g2) at the intake 111 may be different than at the jet exit 134, but a product of the flow rate (Qg2) and density (□g2) may be assumed to be constant. The flow rate (Qg2) and density (□g2) of the gas at the intake 111 may be described based on the flow rate (Qg2) and density (□g0) at the jet exit 134 and the unknown intake pressure (P2). The result is an equation at the intake that the unknown intake pressure, or PIP (P2), can be solved.

Figure 3:
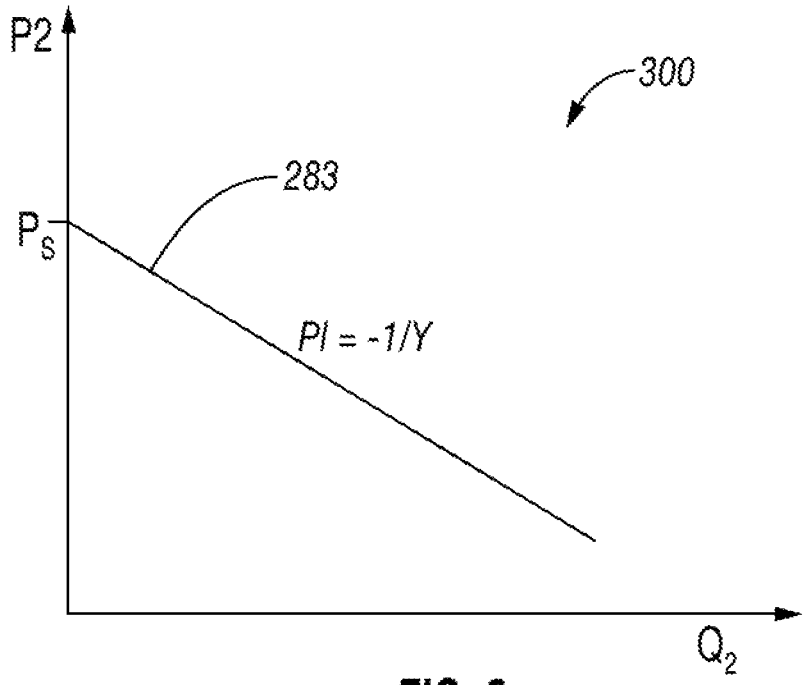
FIG. 3 is a graph depicting an inflow performance relationship between pump intake pressure (PIP (P2)) and liquid production rate (Q2).

An IPR curve may be used to understand the liquid inflow to the well from the reservoir. An example IPR graph 300 is shown in FIG. 3. This graph 300 depicts a curve 283 plotting PIP (P2) (y-axis) versus liquid production rate (Q2) (x-axis). As shown by this curve, the static pressure (Ps) is the value on the y-axis where production rate (Q2) is zero. The curve 283 is depicted as a linear curve assuming single phase flow, but can optionally be non-linear and/or assume multi-phase flow. For the linear curve 283, the slope of the line may be correlated to a productivity index (PI) using the following equation:

$$PI=-1/Y \qquad \text{Eq. (1)}$$

where Y is the slope of the curve plotted in graph 300.

The IPR may be provided, for example, by a wellsite operator or determined, for example, by measuring liquid production rate (Q2) and measuring PIP with a downhole pressure gauge. The IPR may also be determined, for example, using a calculated value for PIP, thereby avoiding the expense of a downhole pressure gauge. In cases where the static pressure at the true vertical depth D of the jet pump is known, the IPR curve may be generated as a straight line through a single point of stable daily liquid production rate (Q2) and calculated or measured PIP (P2).

The IPR may be generated based on known production parameters. For example, the PIP (P2) may be based on daily liquid production rate (Q2). By estimating PIP (P2) for a given daily liquid production over a period of time (e.g., several days, weeks or month), the IPR may be established by fitting a curse to the resulting set of points. To do this, the daily liquid production (Q2) may be used to calculate PEP (P2) each day. To generate the straight line 283 as shown in FIG. 3, a period of stable production may be used. An intercept of this IPR line may be the reservoir pressure (Ps) at the true vertical depth (D) of the jet pump 120. The slope (Y) of the line 283 is related to the PI.

Jet Pump Operation

As shown by FIG. 2B, the 272 optimizing may involve 278—determining jet pump parameters, such as jet pump pressure (P0), based on the pumping parameters. The jet pump pressure may be determined (278) by 278*a*—generating a jet pump pressure (P0) based on the measured pumping parameters (e.g., power fluid pressure (Ppf) and the power fluid flow rate (Qpf) and wellsite parameters (e.g., nozzle area (An), nozzle measured depth (L), etc.) as shown in FIGS. 1A and 1B.

The fluid parameters may be determined based on real time power fluid pressure (Ppf) and flow rate (Qpf) together with production rate (Qp comprised of Qo, Qw and Qg). The production rate (Qp) may be, for example, a daily production rate generated by wellsite operators. The model of the jet pump assumes that the produced fluid 103' is flow is iso-thermal. This assumption may be justified by the short residence of the produced fluid 103' within the jet pump, and/or because the velocity of the gas is high enough so that by the time it cools due to expansion it is already compressing in the diffuser 135.

Thermal equilibrium may not exist at the exit 134 and may occur in the production tubing 108. The jet pump theory also assumes no gas separates or dissolves in the oil within the jet pump 120. Again, the residence time may be too short for this to take place. Finally, the flow may be assumed to be homogeneous and consisting of bubbly flow within a continuous liquid phase, and to have a uniform distribution across the flow cross-section. Therefore, if the pressure becomes low, the expansion of a gas phase may eventually violate this assumption. It is also assumed that the surface separator pressure is constant. The surface separator may be connected hydraulically to the wellhead, and may keep the pressure fixed at surface. If the separator pressure changes, then the wellhead pressure may change. This may cause the power fluid pressure (Ppf) and rate (Qpf) to change. The process may still perform properly; however, the changing surface pressure may be used when converting surface flow rates to downhole flow rates.

The pressure (P1) of power fluid flowing through production tubing to the nozzle 132 may be determined by the following 'tubing equation':

$$P_1=P_{pf}+DG_1-\Delta P_{fr}. \qquad \text{Eq. (2)}$$

where Ppf is the measured power fluid pressure at the surface, D is the true vertical depth of the nozzle, G1 is the pressure gradient of the power fluid, and ΔPfr is the dynamic friction associated with flow through the tubing. This friction term can be calculated in various ways. For example, the following Hazen Williams equation may be used:

$$\Delta P_{fr} = 0.2083 * \frac{L}{100} G_1 \left(\frac{2.916 Q_1}{F}\right)^{1.852} D_t^{-4.8655} \quad \text{Eq. (3)}$$

where Dt is the internal diameter of the production tubing, L is the length of tubing extending from the surface to the nozzle, Q1=Qpf is the power fluid flow rate, and F is a known parameter. Parameter F is normally between 100 and 120, so a value of 110 is assigned. In the case of particularly rough surfaced tubing, the value may be adjusted to, for example, as low as 90 or 80.

The 'nozzle equation' may then be used to determined jet pressure (P0) from P1 using the following;

$$P_0 = P_1 - (1 + K_n) G_1 \left(\frac{Q_1}{857\, A_n}\right)^2 \quad \text{Eq. (4)}$$

where An is the area of the nozzle and Kn is a nozzle loss coefficient. The manufacturer of the jet pump may supply the nozzle co-efficient, or it may be estimated to be, for example, as low as about 0.06 or as high as about 0.12. In another example, the coefficient (Kn) may be set to a value of between about 0.08 to about 0.10.

This determination of jet pressure (P0) may not require stable production rate (Qp), knowledge of the daily production rate (Qp), and/or or knowledge of the PIP (P2). This jet pressure (P0) determination can be determined using the variable driver 122. The determined jet pressure (P0) may be provided to on or offsite locations in displays for real-time monitoring and/or control of the surface pump. The variable driver 122 may be used to generate the jet pressure (P0) and change operation of the pump motor using the variable speed driver. This jet pressure (P0) control may be done in real time, manually, and/or automatically.

The determining 278 also involves 278*b*—generating a jet relationship between the jet pressure (P0) and the drive frequency (FR). As shown in FIG. 1A, when the pump driver 122 is operating at a frequency (f*), the pressure and rate of the power fluid 107 at the frequency f* may be given by Ppf(f*) and Q1(f*). The pressure (Ppf(f*)) may be measured using the pressure gauge G and the flow rate (Q1(f*)) may be measured using the flow meter M.

If the surface pump 118 is a centrifugal pump, then changing frequency of the surface pump 118 and/or pump motor 128 changes the pressure Ppf and rate Q1f of the power fluid, respectively, as follows:

$$P_{pf}(f) = \left(\frac{f}{f^*}\right)^2 P_{pf}^* \quad \text{Eq. (5)}$$

and $$Q_1(f) = \left(\frac{f}{f^*}\right) Q_1^* \quad \text{Eq. (6)}$$

where f is a hypothetical new operating frequency, $P_{pf}(f)$ is the pressure of the power fluid at the hypothetical frequency f, and $Q_1(f)$ is the flow rate of the power fluid at the hypothetical frequency f. These equations may be used to predict the pressure and flow rate of the power fluid at various frequencies. Because the friction term is small and the exponent is close to 2, we have $$P_0^f = \left(\frac{f}{f^*}\right)^2 (P_0^* - DG_1) + DG_1 \quad \text{Eq. (7)}$$

Based on Eq. (7) and assuming DG1 is greater than P0*, the jet pressure (P0) decreases with frequency.

Figure 4:
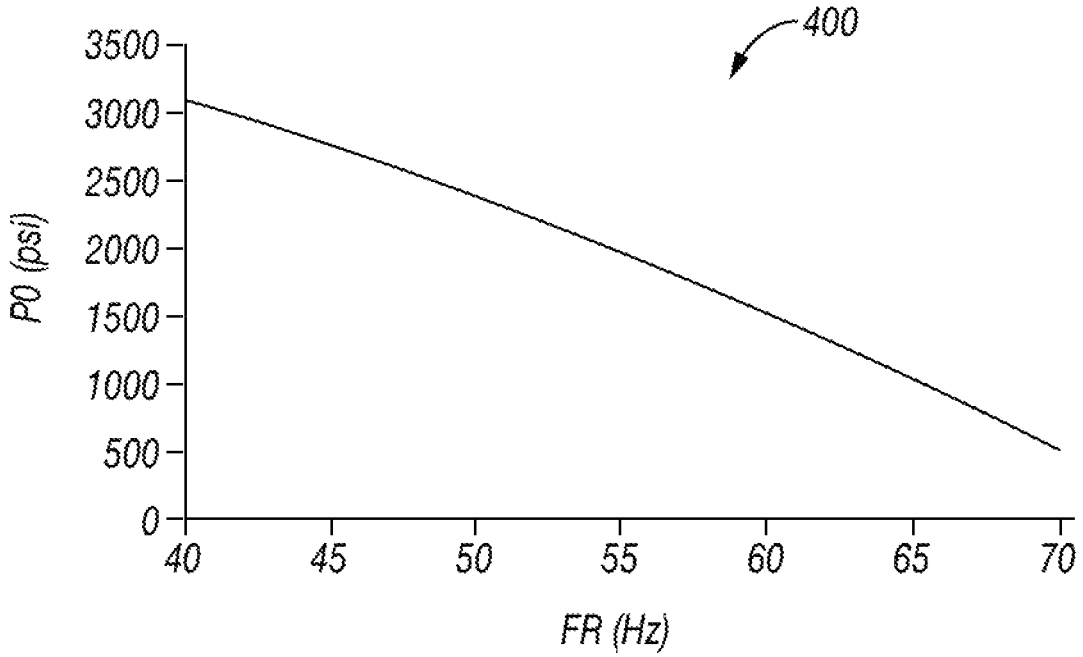
FIG. 4 is a graph depicting a relationship between jet pressure (P0) and drive frequency (FR).

FIG. 4 shows an example graph 400 (jet pressure curve) depicting jet pressure (P0) (y-axis) versus drive frequency (FR) (x-axis) for a pump pumping power fluid through a jet pump (which may be similar to those shown in FIG. 1A). In this example, the surface pump is a centrifugal pump pumping, power fluid to a jet pump at a depth of 10,000 ft (3048 m). As shown by graph 400, the jet pressure (P0) is about 1500 psi (10.34 MPa) when the pump operates at a frequency of about 60 Hz.

Optimizing Production Using an Intake Drive Frequency (FR) that Minimizes the Jet Pump Intake Pressure The 272 optimizing may involve 280*a*—determining an intake drive frequency (FR) that minimizes the jet PIP (P2). In this version, a relationship between. PIP (P2) and jet pressure (P0) when daily production (Pr) is known but an IPR is no longer required. The determining (280*a*) may involve (280*a*1) detecting a stability period. The stability period may be a period of time during production when the pumping parameters remain within a predetermined range for at least a minimum duration.

Accumulated production of subsurface fluids (total or in separate phases—oil, water and gas) may be measured and/or collected from a producer at the wellsite over a time period. These values may be measured at the same time every day, for example at 8 am. This production data may be combined with pumping measurements, such as power fluid rate (Qpf) and power fluid pressure (Ppf) taken at the wellsite and collected by the pump driver 122.

The pump driver 122 may be used to monitor power fluid rate (Q1) and pressure (Ppf) at the discharge of the surface centrifugal pump over each period (e.g., a 24-hour period from 8 am to 8 am). If the power fluid rate and pressure are nearly constant during this period, or trending slowly, then the production for that day is considered to be stable.

Stable daily production may be determined by measuring production rate (QP) within a measurement period (e.g., 24 hour or daily cycles) and verifying the production rate (QP) remains within a predetermined range. To determine if production is stable, real time measurements of pressure and flowrate (e.g., Ppf, Qpf) from the surface pump during this period may be measured. Out of range conditions and/or shifting trends may be detected. Predetermined ranges and/or mathematical variations may be defined. Alarms may optionally be provided to determine whether an out of range instance has occurred. If these measurements are free of sudden changes or transient behavior, then the production is considered stable. These measurements can trend gradually throughout the day and still be considered stable.

Periods of a given duration (e.g., about 1 day) may be examined to determine whether the production rate (QP) has remained within the predetermined range and/or a stable trend. Periods of stability define a static period. The pumping pressure (Ppf) during the static period is defined as the static pressure.

Figure 5A:
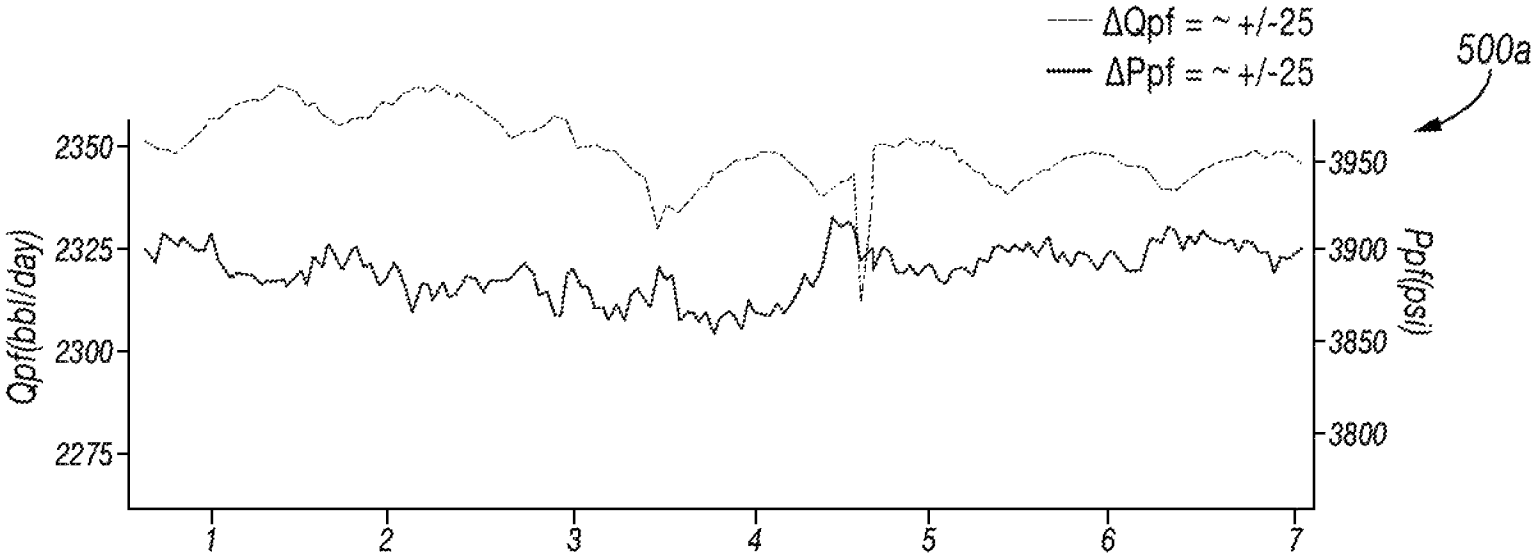
Figure 5B:
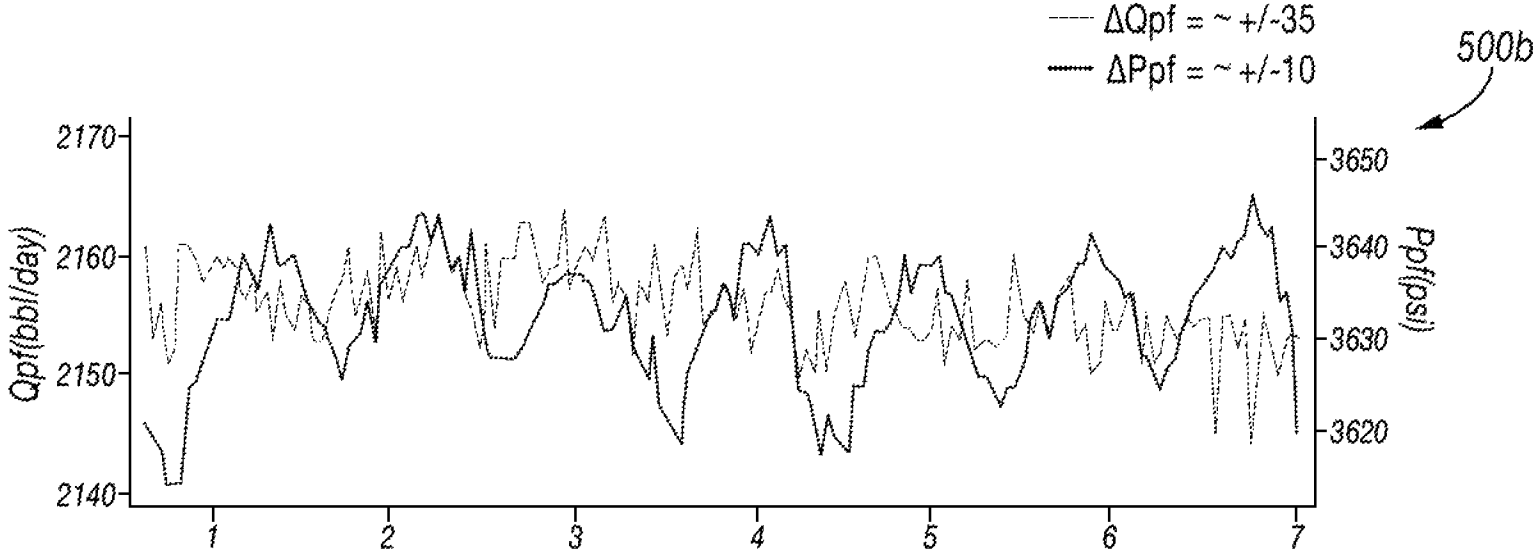

FIGS. 5A-5D are graphs 500*a-d* depicting stability examples. FIGS. 5A and 5B show graphs 500*a-b* indicating stable production. Graphs 500*a-b* depict power fluid rate (y1-axis) and power fluid pressure (y2-axis) versus time (x-axis). These graphs may be generated, for example, from the pressure gauge Gj and meter Mj coupled to the surface pump of FIG. 1 during production from the wellsite 100.

As shown by FIG. 5A, the power fluid rate (Qpf=Q1) remains within a range of about +/−25 bbls/day (bpd) within the window shown. While an event appears on Day 4, the variation is within the predetermined range. Optionally, the production for Day 4 may be removed to eliminate the event from the production range. Similarly, FIG. 5B shows cyclical production over the window shown, but all variation is within a predetermine range of about +/−10 bbl/day (bpd).

Figure 5D:
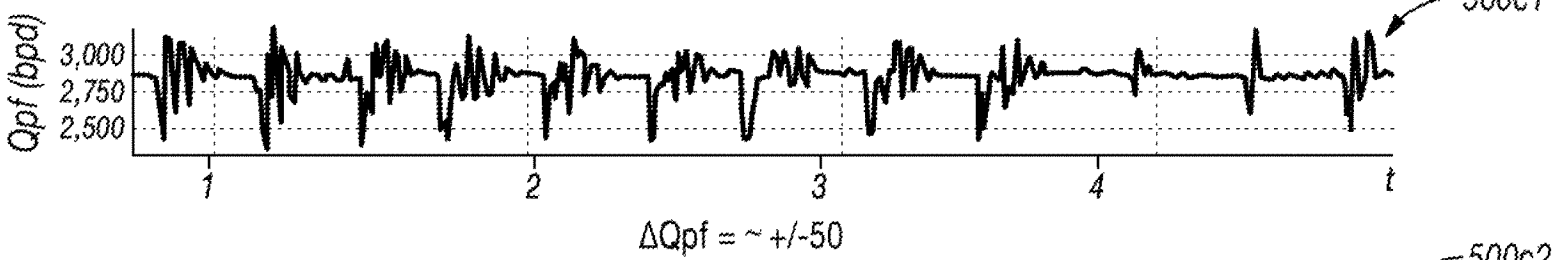
Figure 5D:
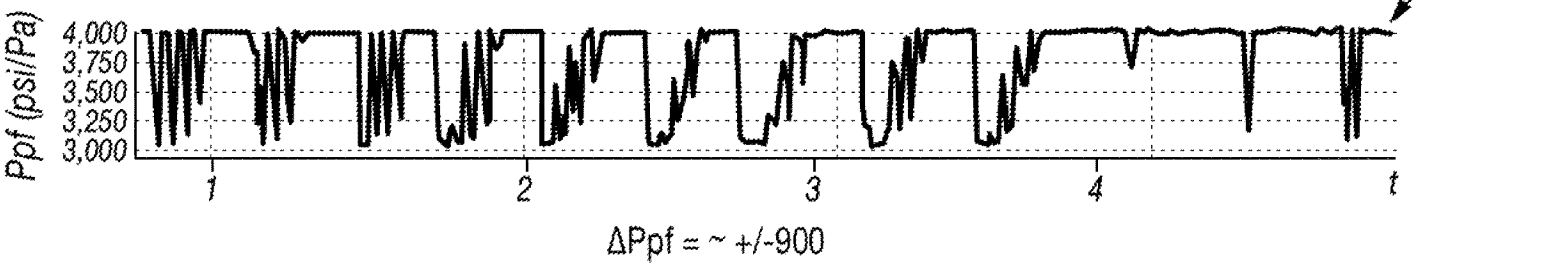
Figure 5D:
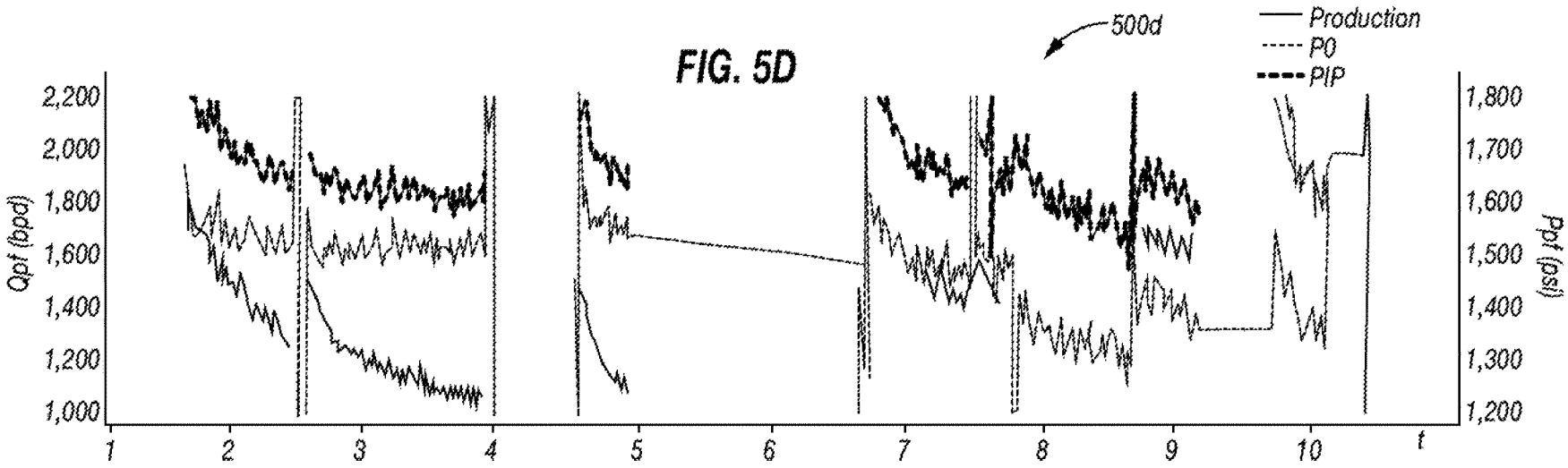

FIGS. 5C, 5C2 and 5D show graphs 500*c*1,*c*2,*d* depicting unstable production. Graph 500*c*1-*c*2 depict power fluid rate (Qpf=Q1) (y1-axis) and power fluid pressure (Ppf) (y2-axis), respectively, versus time (x-axis) generated from the pressure gauge Gj and meter Mj. In this version, the ranges of variations are more than +/−500 bbl/day (bpd), thereby indicating wide fluctuations resulting in instability.

The example of FIG. 5D plots liquid production flow rate (Qp) (y1-axis) and power fluid rate (Ppf) over time (t). This graph shows that the liquid production in real-time, jet pressure (P0), and PIP (P2) as depicted follow similar trends. These trends also show that wide variation of about +/−300 bbls/day may occur within the window shown, thereby indicating transient conditions, or unstable flow. FIG. 5D also shows a case where showing a real-time liquid production measurement, which is highly unusual. In this case, the pumping system has started and stopped several times. Each time it re-starts, there is a 'transient' period where pressure and rate decline. There are no days in this graph 500*d* where production is considered stable.

For periods of stability and given known equipment parameters of the jet pump, such as the tubing, nozzle and intake and known production data, PIP (P2) and a corresponding drive frequency (FR) to achieve minimum PIP (P2) can be determined. When combined with the daily production values for that day, and other values that are known, the dependence of PIP (P2) can be plotted versus drive frequency (FR) (DF). In this way, the drive frequency (FR) that minimizes PIP (P2) (and maximizes production) is determined. The surface pump is then operated at the selected drive frequency (FR). The process may be repeated by operating at the new drive frequency (FR), determining production stabilization, and determining a drive frequency (FR) that minimizes PIP (P2) for the new production rate (QP).

The 280*a* determining also involves 280*a*2—determining an intake variation of PIP (P2) with jet pressure (P0). The determining (280*a*2) may be performed during the static period of 280*a*1. The PIP (P2) may be determined by the following intake equation which governs the relationship of the PIP (P2) to the jet pressure (P0):

$$P_2 + \frac{P_2 Q_{g2}}{Q_2}\ln\left(\frac{P_2}{P_o}\right) = P_0 + (1 + K_{en})\left(G_2 + \frac{Q_{g2}G_{g2}}{Q_2}\right)\left(\frac{Q_2 + \frac{P_2 Q_{g2}}{P_0}}{857(A_t - A_n)}\right)^2 \quad \text{Eq. (8)}$$

where G2 is the pressure gradient of the liquid at the pump intake 111, Q2 is the liquid flow rate of the liquid at the PIP (P2), Gg2 is the pressure gradient of the gas at the PIP (P2) and Qg2 is the gas flow rate at the PIP (P2). $A_t$ is the area of the throat (133 of FIG. 1B), and Ken is the loss coefficient for the pump intake. Ken may be assumed to be 0.

The values of G2, Q2, Gg2 and Qg2 may be computed from the daily production rate at the surface (QP comprising Qo, Qw and Qg) and specific gravities of the phases (e.g., oil (▨), water (▨), and gas (▨) of the produced fluid 103' at the surface, wellhead pressure (PW) and temperature (TW), the temperature (Tp) at the jet pump 120 and the pressure at the intake PIP (P2). Because P2 is not known and P0 is known from equation (4), G2, Q2, Gg2 and. Qg2 at P0 may be determined. This may be done using PVT correlations as described further herein. The use of daily production rate (QP) assumes that the production rate (QP) is stable throughout the 24 hour period for the day. If the production rate (QP) is not stable, then the solution for the intake equation for PIP (P2) may result in some type of average PIP (P2) for the day.

The intake equation (8) for P2 may be solved using, for example, the Newton Raphson method. The calculation of PIP (P2) may be done using the known value of P0. Once P2 is calculated, G2, Q2, Gg2 and Qg2 are recalculated using this value of P2. With the new G2, Q2, Gg2 and Qg2, P2 is recalculated again. This process repeats until the calculated value of P2 converges to a constant value.

The values of G2, Q2, Gg2 and Qg2 may be computed from the daily production rate at the surface (QP comprising Qo, Qw and Qg) and specific gravities of the phases (e.g., oil (Qo), water (Qw), and gas (Qg)) of the produced fluid 103' at the surface, wellhead pressure (PW) and temperature (TW), the temperature (Tp) at the jet pump 120 and the pressure at the intake PIP (P2). Because P2 is not blown, in an alternative method, we may guess a value for P2 to calculate the values of G2, Q2, Gg2 and Qg2. Only the correct value for P2 will solve Equation (8). By trying a range of values for P2, we can find the value that solves Equation (8).

The calculation of the PIP (P2) may be used as a virtual real-time downhole pressure gauge using stable daily production values. During operation, the pump driver 122 may be used to generate the PIP (P2) which may be viewed by users. For given surface production, the intake equation (8) may be used to plot the variation of PIP (P2) with jet pressure (P0).

Figure 6A:
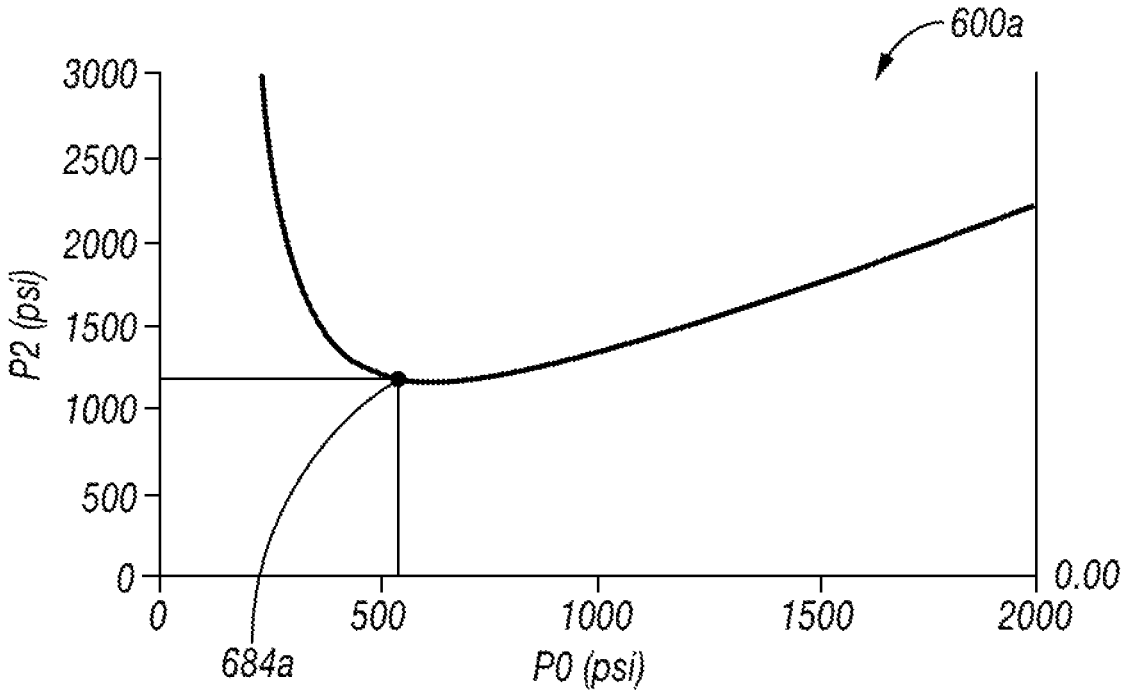
FIG. 6A is a graph depicting a relationship between PIP (P2) and jet pressure (P0).

An example intake curve 600*a* is shown in FIG. 6A. The graph 600*a* plots PIP (P2) (y-axis) versus jet pressure (P0) (x-axis). As shown in the example depicted in FIG. 6A, a minimum PIP (P2) 684*a* occurs at a jet pressure (P0) about 500 psi (3.44 MPa). This intake curve 600*a* indicates that lowering the jet pressure (P0) below about 400 psi (2.75 MPa) may cause the PIP (P2) to rise, which may reduce the production rate (QP). Raising the jet pressure (P0) above about 500 psi (3.44 MPa) may also raise PIP (P2), and thereby reduce the production rate (QP).

The 280*a* determining also involves 280*a*3—determining a frequency variation of the PIP (P2) with drive frequency (FR) based on the intake variation of 280*a*2. In the case where there is no free gas at the intake 111, then Qg2 equals zero and the intake equation (8) simplifies to the following:

$$P_2 = P_0 + (1 + K_{en})G_2\left(\frac{Q_2}{857(A_t - A_n)}\right)^2 \quad \text{Eq. (9)}$$

Figure 6B:
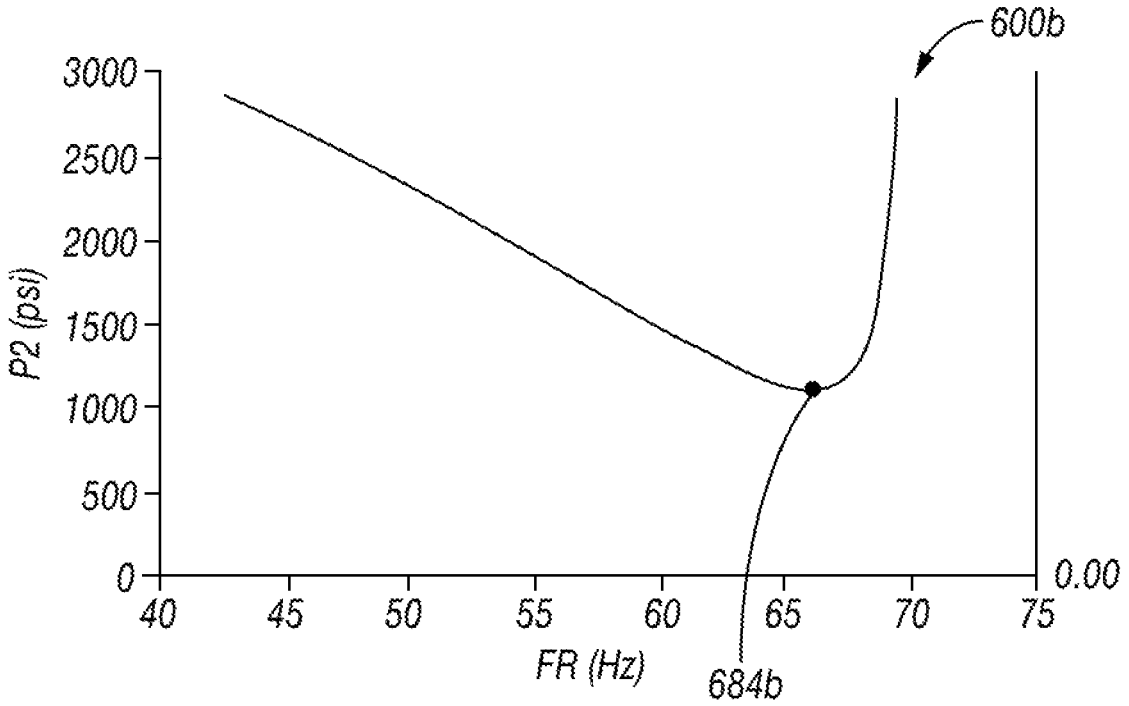
FIG. 6B is a graph depicting a relationship between PIP (P2) and drive frequency (FR).

In this case, the relationship may be considered linear, and PIP (P2) may be minimized by minimizing the jet pressure (P0). The PVT calculations described herein indicate whether there is free gas at the PIP (P2) 111. The jet variation of FIG. 4 can then be combined with the intake variation of FIG. 6A to yield the frequency variation as shown in FIG. 6B. FIG. 6B is a graph 600*b* plotting PIP (P2) versus drive frequency (FR).

The determining 280*a* continues with 280*a*4—identifying an optimum intake drive frequency (FR) based on the intake variation. Using the frequency variation of FIG. 6B, a minimum PIP (P2) of the frequency variation may be determined. As shown in the example of FIG. 6B, graph 600*b* depicts a maximum production rate (QP) 684*b* optimized at about 65 Hz.

Optionally, the determined PIP (P2) during stability may be used to (280*b*5) determine a synthetic IPR.

Optimizing Production Using a Production Drive Frequency (FR) that Maximizes the Liquid Production Rate The optimizing 272 may also involve 280*b* determining a production drive frequency (FR) that maximizes the liquid production rate (Q2). In this example, the IPR is available and production rate (QP comprised of Qo, Qw, and Qg) is not required to determine the drive frequency (FR). The liquid production rate (Q2) may be determined versus drive frequency (FR) using the IPR curve, and the drive frequency (FR) that maximizes the liquid production rate (Q2) may be determined. In this example, real-time flow rates (Q2) and PIP (P2) may not depend on the availability of daily production values. The past history of daily production may be used to identify the IPR curve, but this may be done offline rather than in real-time.

The determining (280*b*) involves 280*b*1—generating the IPR. The IPR may be provided, for example, from an operator or determined as indicated further herein (see, e.g., FIG. 3). The IPR curve may be assumed to be linear as represented by the following:

$$P_2 = P_S - \frac{Q_2}{PI} \qquad \text{Eq. (10)}$$

Where Ps is the static pressure at the pump intake 111 and PI is the productivity index. The IPR may also be determined as described with respect to the determining an IPR.

The method 280*b* also involves 280*b*2—applying the inflow performance relationship curve to a relationship between the pump intake pressure PIP (P2) and the jet pressure (P0). Assuming that IPR and PI are provided, the IPR curve may be generated (see, e.g., FIG. 3). The IPR curve may be inserted into the intake equation (8) as follows:

$$P_S - \frac{Q_2}{PI} + \frac{\left(P_S - \frac{Q_2}{PI}\right)Q_{g2}}{Q_2}\ln\left(\frac{P_S - \frac{Q_2}{PI}}{P_o}\right) = P_0 + (1 + K_{en})\left(G_2 + \frac{Q_{g2}G_{g2}}{Q_2}\right)\left(\frac{Q_2 + \frac{\left(P_S - \frac{Q_2}{PI}\right)Q_{g2}}{P_0}}{857(A_t - A_n)}\right)^2 \qquad \text{Eq. (11)}$$

Equation (11) governs the relationship between the liquid production rate (Q2) and the jet pressure (P0). The values of G2, Q2, Gg2 and Qg2 may be computed from the daily production rate at the surface (QP comprising Qo, Qw and Qg) and specific gravities of the phases (e.g., oil (□o), water (□w), and gas (□g)) of the produced fluid 103' at the surface, wellhead pressure (PW) and temperature (TW), the temperature (Tp) at the jet pump 120 and the pressure at the intake PIP (P2).

Because P2 is not known and P0 is known from equation (4), G2, Q2, Gg2 and Qg2 at P0 may be determined using PVT correlations as described further herein. The use of daily production rate (QP) assumes that the production rate (QP) is stable throughout the 24 hour period for the day. If the production rate (QP) is not stable, then the solution for the intake equation for PIP (P2) may result in some type of average PIP (P2) for the day.

The intake equation for Q2 may be solved using, for example, the Newton Raphson method. The calculation of Q2 may be done using the known value of P0. Once Q2 is calculated, P2 is calculated using Eq. (10), and G2, Q2, Gg2 and Qg2 are recalculated using this value of P2. With the new G2, Q2, Gg2 and Qg2, Q2 is recalculated again. This process repeats until the calculated value of Q2 converges to a constant value.

Because Q2 is not known, in an alternative method, we may guess a value for Q2, use (10) to calculate P2, and use this value of P2 to calculate the values of G2, Q2, Gg2 and Qg2. Only the correct value for Q2 will solve Eq. (11). By trying a range of values for Q2, we can find the value that solves Eq. (11).

This may be solved for the production rate (Q2) as a function of jet pressure using the Newton Raphson method.

Figure 7A:
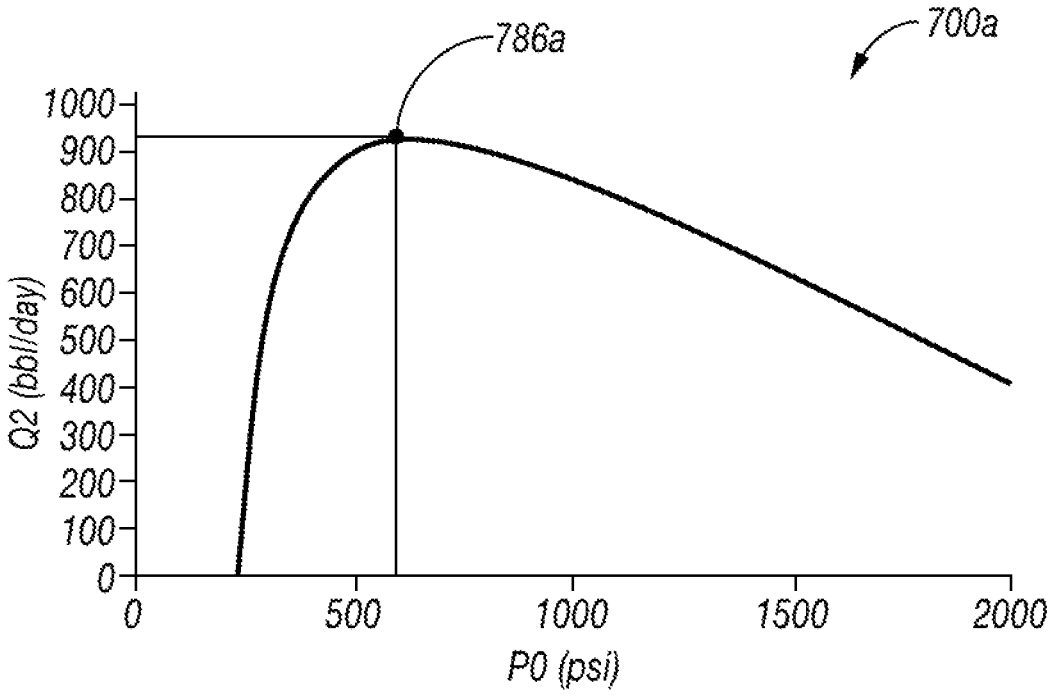
FIG. 7A is a graph depicting a relationship between liquid production rate (Q2) and jet pressure (P0).
Figure 7B:
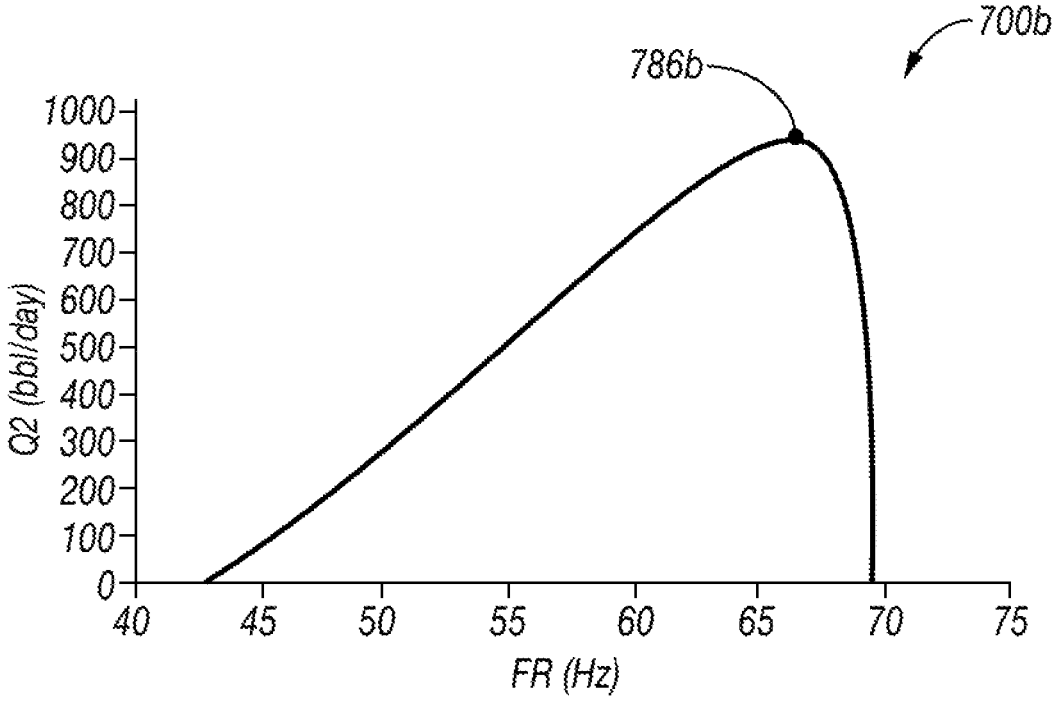
FIG. 7B is a graph depicting a relationship between liquid production rate (Q2) and drive frequency (FR).
Figure 8A:
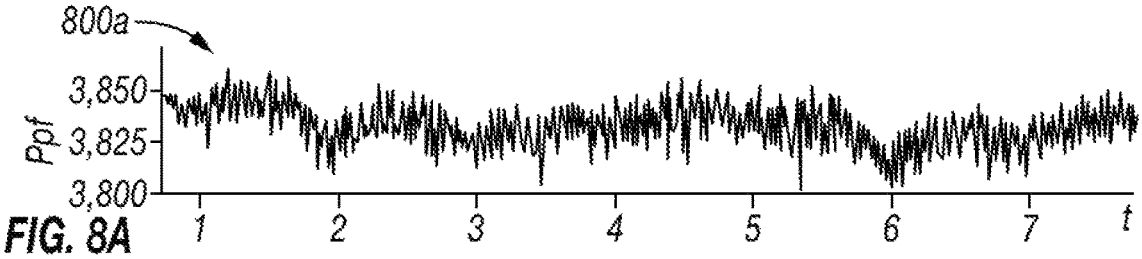
FIGS. 8A-8F are graphs depicting various flow rates and pressures of various fluids at the wellsite.
Figure 8B:
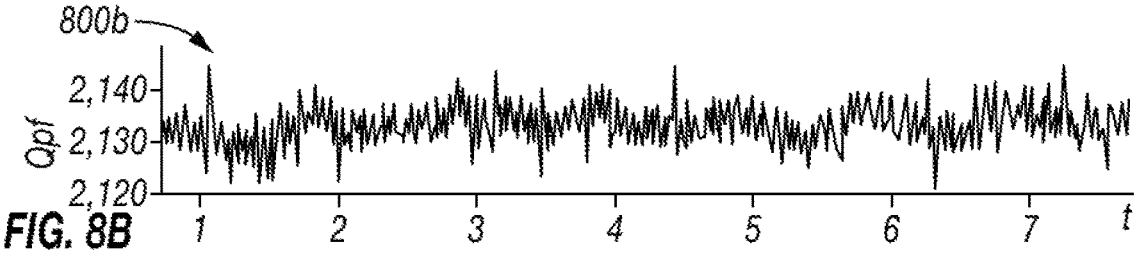
Figure 8C:
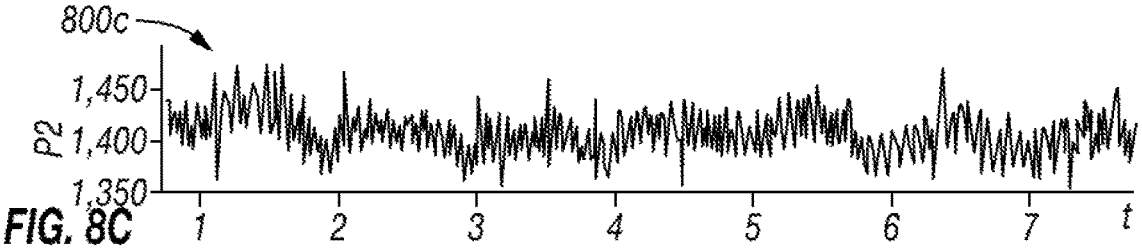
Figure 8D:
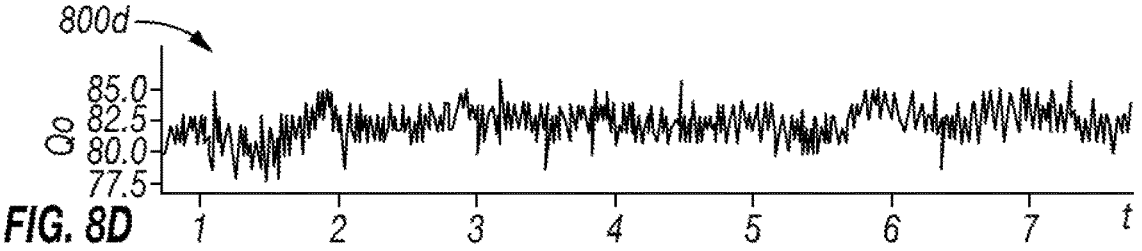
Figure 8E:
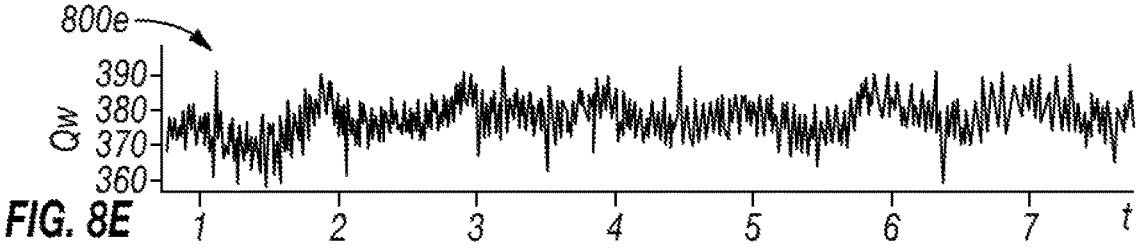
Figure 8F:
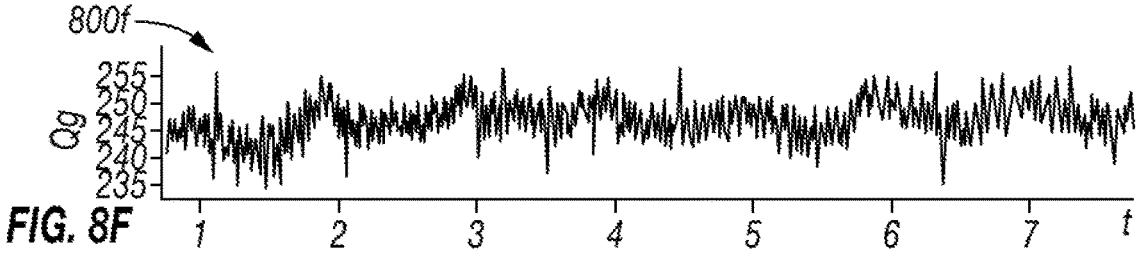

The method 280*b* also involves 280*b*3—determining a production variation of the liquid production rate (Q2) with the jet pressure (P0) based on the jet relationship. An example of a production relationship depicting liquid production rate (Q2) versus jet pressure (P0) is shown in FIG. 7A. FIG. 7A is a graph 700*a* plotting production rate (Q2) (y-axis) versus jet pressure (P0) (x-axis). The graph 700*a* shows a peak depicting a maximum production rate (Q2) 786*a* for a jet pressure (P0) of about 500 psi (3.44 MPa).

The method 280*b* also involves 280*b*4—determining a frequency variation of the production rate (Q2) with the drive frequency (FR) based on the production relationship. The frequency variation may be determined by combining the production relationship of FIG. 7A with the jet pressure (P0) relationship of FIG. 4. FIG. 7B is a graph 700*b* depicting production rate (Q2) versus drive frequency (FR) generated from a combination of FIG. 4 and FIG. 7A.

The method 280*b* continues by 280*b*5—identifying a production based optimum drive frequency (FR) at a maximum production rate (Q2) of the frequency variation. The optimal drive frequency (FR) may be selected at a peak 768*b* along the curve which corresponds to a maximum production rate (Q2) at 786*b* along the graph 700*b*.

The resulting optimum drive frequency may be cross checked by comparing the optimum drive frequency generated at 280*b*5 with the frequency generated at 280*a*4. The comparison may involve comparing the identified optimum drive frequency generated at 280*b*5 for maximum production rate (Q2) to the optimum drive frequency generated for minimum intake pressure (P2) at 280*a*4. If a given difference exists, review of the pumping, production, and/or measurement process may need to be performed to assure proper results.

Once an optimum intake drive frequency (FR) is identified, the optimizing 272 may continue with 282 adjusting the drive frequency (FR) to the optimum drive frequency (FR). In performing the 280*a* determining, the variation of PIP (P2) with jet pressure (P0) or frequency (FR) may be determined by assuming the reservoir production is fixed and, therefore, does not change with the PIP (P2). In reality, the production rate (Q2) may change with PIP (P2). To address variations in liquid production rate (Q2), the stable daily liquid production rate (Q2) for a specific day may be used. Based on this, the jet pressure (P0) may be adjusted to correspond to optimum production by changing frequency (FR) as indicated by FIG. 5B. The determining 280*a* and/or portions thereof may be repeated over time for one or more stable daily production rate (QP).

Production Rate (QP) for Phases

Optionally, production rate (QP) for phases (e.g., oil, gas, and water) of the produced fluid may be determined. Having estimated the liquid production rate at the intake (Q2) 280*b*4 a virtual three phase surface flowmeter may be provided. From the liquid flow rate (Q2) at this pressure (P2), the liquid flow rate (Qp comprised of Qo, Qw and Qg) at the surface can be determined. Assuming the producing gas oil ratio (PGOR) of the reservoir oil is known, and the water cut (WC) is also known, flow rates for oil, water and gas at the surface can be determined. These may be known from the history of daily production used to identify the IPR curve.

Having solved for Q2, the oil, water and gas flow rates at the surface may be determined from the following:

$$Q_o = \frac{Q_2(1 - WC)}{B_o + (1 - B_o)WC} \quad \text{Eq. (12)}$$

$$Q_w = \frac{Q_o WC}{1 - WC} \quad \text{Eq. (13)}$$

$$Q_g = \frac{(PGOR)Q_o}{1000} \quad \text{Eq. (14)}$$

The PGOR and WC may be known values provided, for example, by the operator. An example of the real-time 3-phase flowmeter is shown below.

FIGS. 8A-8F This real-time flowmeter may be generated from the Q2 value obtained utilizing the IPR curve in 280*b*. These FIGS. 8A-8F depict graphs 800*a-f* plotting Ppf, Qpf, P2=PIP, Qo, Qw and Qg, respectively over time. The PVT correlations may be used to calculate the values of G2, Q2, Gg2 and Qg2 based on the following:

$$Q_2 = Q_w + Q_o B_o \quad \text{Eq. (15)}$$

Where Qo is the oil production rate at the surface, Qw is the water production rate at surface, and B0 is the oil volume factor. The oil volume factor may be determined from the following:

$$B_0 = 0.98496 + 0.0001\{R_s^{0.755}\gamma_g^{0.25}\gamma_o^{-1.5} + 0.45T\}^{1.5} \quad \text{Eq. (16)}$$

where Rs is the 'solution GOR', □o is specific gravity of the oil, □g is the specific gravity of the gas and T is the temperature of the produced fluid at the surface.

API is the oil API gravity related to the oil specific gravity by the following:

$$\gamma_o = \frac{141.5}{131.5 + API} \quad \text{Eq. (17)}$$

The solution gas-oil ratio may be calculated at pressure P using the following:

$$R_s = (0.0315)\gamma_g^{0.7587}\, 10^{\left(\frac{(11.289)API}{T+460}\right)}(P + 14.7)^{1.0937}\left[\frac{\text{ft}^3}{\text{bbl}}\right] \quad \text{Eq. (18)}$$

G2 may be determined from the following:

$$G_2 = \frac{1}{144}\frac{\rho_0 Q_o B_o + \rho_w Q_w}{Q_o B_o + Q_w}\left[\frac{\text{psig}}{\text{ft}}\right] \quad \text{Eq. (19)}$$

where $$\rho_o = \frac{350\gamma_o + 0.0764\gamma_{g100}R_s}{5.615B_o} \quad \text{Eq. (20)}$$

and $$\rho_w = 62.4\gamma_w\left[\frac{\text{lbm}}{\text{ft}^3}\right] \quad \text{Eq. (21)}$$

Qg2 may be determined from the following:

$$Q_{g2} = \frac{(PGOR - R_s)Q_o B_g}{5.615}\ [\text{bpd}] \quad \text{Eq. (22)}$$

where PGOR is the producing gas/oil ratio (Qg/Qo) and where $$B_g = \left(\frac{14.7}{P + 14.7}\right)\left(\frac{T + 460}{60 + 460}\right)Z\ [-] \quad \text{Eq. (23)}$$

where T is the bottomhole temperature at the jet pump which may be provided by the operator, and where:

$$Z = A + BP_{red} + (1 - A)\exp(-C) - D\left(\frac{P_{red}}{10}\right)^4\ [-] \quad \text{Eq. (24)}$$

where $$T_r = \frac{T + 460}{169.2 + 349.5\gamma_{g100} - 74.0\gamma_{g100}^2}\ [-] \quad \text{Eq. (25)}$$

$$P_{red} = \frac{P_0 + 14.7}{756.8 - 131.0\gamma_{g100} - 3.6\gamma_{g100}^2}\ [-] \quad \text{Eq. (26)}$$

$$A = -0.101 - 0.36T_r + 1.3868\sqrt{T_r - .919} \quad \text{Eq. (27)}$$

$$B = .0021 + \frac{0.04275}{T_r - 0.65} \quad \text{Eq. (28)}$$

$$C = P_{red}(E + FP_{red} + GP_{red}^4) \quad \text{Eq. (29)}$$

$$D = 0.122\exp[-11.3(T_r - 1)] \quad \text{Eq. (30)}$$

$$E = 0.6222 - 0.224T_r \quad \text{Eq. (31)}$$

$$F = \frac{0.0657}{T_r - 0.85} - 0.037 \quad \text{Eq. (32)}$$

$$G = 0.32\exp[-19.53(T_r - 1)] \quad \text{Eq. (33)}$$

Gg2 may be determined from the following:

$$G_{g2} = \frac{0.0764\gamma_g}{144B_g}\ [\text{psi/ft}] \quad \text{Eq. (34)}$$

While the embodiments are described with reference to various implementations and exploitations, it will be understood that these embodiments are illustrative and that the scope of the inventive subject matter is not limited to them. Many variations, modifications, additions and improvements are possible. For example, various combinations of one or more of the features provided herein may be used.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

Insofar as the description above and the accompanying drawings disclose any additional subject matter that is not within the scope of the claim(s) herein, the inventions are not dedicated to the public and the right to file one or more applications to claim such additional invention is reserved. Although a very narrow claim may be presented herein, it should be recognized the scope of this invention is much broader than presented by the claim(s). Broader claims may be submitted in an application claims the benefit of priority from this application.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A jet pump system for facilitating production of a subterranean fluid from a wellbore at a wellsite, the wellbore having production tubing disposed therein, the production tubing having a production meter to measure a production rate of the subterranean fluid, the jet pump system comprising:

a jet pump deployed into the wellbore;

a surface pump fluidly coupled to the jet pump to pump a power fluid through the jet pump;

one or more surface pump gauge, meter, or sensor coupled to the surface pump to measure pumping parameters, the measured pumping parameters comprising power fluid parameters of the power fluid; and a pump driver coupled to the one or more surface pump gauge, meter, or sensor, the pump driver being configured to receive the measured pumping parameters, the pump driver being coupled to the surface pump to change a speed or torque of a motor of the surface pump based on the measured pumping parameters and the production rate of the subterranean fluid, the pump driver being configured to determine either a first relationship between the production rate of the subterranean fluid and a jet pressure at a downstream side of a nozzle of the jet pump or a second relationship between a pump intake pressure at an intake of the jet pump and the jet pressure at the downstream side of the nozzle of the jet pump, and the pump driver being configured to selectively vary pumping of the power fluid into the wellbore to optimize production based on a target jet pressure at the downstream side of the nozzle of the jet pump that is determined based on either the first relationship or the second relationship, wherein the target jet pressure at the downstream side of the nozzle of the jet pump is either a maximum of the first relationship or a minimum of the second relationship.

2. The jet pump system of claim 1:

wherein the wellsite has production equipment disposed about the wellbore to produce the subterranean fluid according to production parameters, the production parameters comprising the production rate of the subterranean fluid;

the jet pump system further comprising a downhole assembly, the downhole assembly comprising an intake configured such that the subterranean fluid flows into the intake;

the jet pump comprising the nozzle, a throat, and an exit port configured such that the power fluid passes through the nozzle, the power fluid and the subterranean fluid flow into the throat, and the power fluid and the subterranean fluid exit the jet pump through the exit port;

the surface pump comprising the pump motor, wherein the measured pumping parameters further comprise a drive frequency of the pump motor; and wherein the pump driver comprises sensor inputs coupled to the one or more surface pump gauge, meter, or sensor to receive the measured pumping parameters, wherein the sensor inputs further receive the measured production parameters;

wherein the pump driver further comprises a processing unit programmed to determine, based on the power fluid parameters and measured production parameters, either a third relationship between the production rate of the subterranean fluid and the drive frequency of the pump motor or a fourth relationship between the pump intake pressure at the intake of the jet pump and the drive frequency of the pump motor; and wherein the pump driver further comprises a variable speed drive coupled to the pump motor of the surface pump and configured to change the drive frequency based on either the third relationship or the fourth relationship, whereby the surface pump is selectively varied to optimize production.

3. The jet pump system of claim 2, wherein the pump motor has a rotatable shaft, the rotatable shaft rotatable at the drive frequency.

4. The jet pump system of claim 3, wherein the variable speed drive is coupled to the surface pump gauge to change the drive frequency of the pump motor based on the surface pump gauge.

5. The jet pump system of claim 2, wherein the pump driver further comprises a rectifier.

6. The jet pump system of claim 2, wherein the pump driver further comprises an inverter.

7. The jet pump system of claim 2, wherein the pump driver further comprises an input/output device or a communicator.

8. The jet pump system of claim 2, wherein the variable speed drive is configured to change the drive frequency based on either a maximum of the third relationship or a minimum of the fourth relationship.

9. The jet pump system of claim 8, wherein the power fluid parameters comprise power fluid pressure and jet pump pressure.

10. The jet pump system of claim 8, wherein the sensor inputs are further coupled to one or more production gauge, meter, or sensor coupled to the production equipment to measure the production parameters of the subterranean fluid produced from the wellbore.

11. The jet pump system of claim 10, wherein the sensor inputs are coupled to the one or more production gauge, meter, or sensor to receive the measured production parameters therefrom, and wherein the pump driver varies the drive frequency of the surface pump.

12. The jet pump system of claim 10, wherein the sensor inputs are coupled to sensors positioned about the wellsite to receive wellsite parameters therefrom.

13. The jet pump system of claim 1, wherein the pump driver is further configured to determine, based on the power fluid parameters and measured production parameters, a relationship between the jet pressure at the downstream side of the nozzle of the jet pump and the pump intake pressure at the intake of the jet pump.

14. The jet pump system of claim 13, wherein the pump driver is further configured to determine, based on the power fluid parameters, the jet pressure at the downstream side of the nozzle of the jet pump.

15. A jet pump method for facilitating production of a subterranean fluid from a wellbore at a wellsite, the wellbore having production tubing disposed therein, the production tubing having a production meter to measure a production rate of the subterranean fluid, the jet pump method comprising:

deploying a jet pump into the wellbore;

pumping power fluid through the jet pump using a surface pump coupled to the jet pump;

measuring, using one or more surface pump gauge, meter, or sensor coupled to the surface pump, pumping parameters of the surface pump, the measured pumping parameters comprising a speed or torque of a motor of the surface pump and power fluid parameters of the power fluid;

generating production parameters of the subterranean fluid produced at the surface, the production parameters comprising the production rate of the subterranean fluid; and coupling a pump driver to the one or more surface pump gauge, meter, or sensor, the pump driver being configured to receive the measured pumping parameters;

coupling the pump driver to the surface pump change the speed or torque of the surface pump based on the measured pumping parameters and the production rate of the subterranean fluid;

determining, with the pump driver, either a first relationship between the production rate of the subterranean fluid and a jet pressure at a downstream side of a nozzle of the jet pump or a second relationship between a pump intake pressure at an intake of the jet pump and the jet pressure at the downstream side of the nozzle of the jet pump;

optimizing, with the pump driver, the production of the subterranean fluid based on either a maximum of the first relationship or a minimum of the second relationship to determine a target jet pressure at the downstream side of the nozzle of the jet pump, wherein the target jet pressure at the downstream side of the nozzle of the jet pump is either the maximum of the first relationship or the minimum of the second relationship; and changing the speed or torque of the surface pump based on the target jet pressure at the downstream side of the nozzle of the jet pump, the measured power fluid parameters and the generated production parameters.

16. The jet pump method of claim 15, further comprising positioning production equipment about the wellbore at the wellsite, the production equipment comprising the production tubing.

17. The jet pump method of claim 16, further comprising producing the subterranean fluid to the surface via the production tubing.

18. The jet pump method of claim 15, wherein the generating production parameters comprises at least one of measuring one of in real time and measuring over time.

19. The jet pump method of claim 15, further comprising repeating the pumping, measuring, generating, and optimizing until production rate remains within a predetermined range.

20. The jet pump method of claim 15, wherein the changing of the speed or torque of the surface pump comprises determining jet pump parameters based on the pump parameters by:

generating the jet pressure of the jet pump based on the measured pumping parameters and the jet pump parameters of the jet pump; and generating a jet relationship between the jet pressure and a drive frequency.

21. The jet pump method of claim 20, wherein the changing of the speed or torque of the surface pump further comprises determining an optimum drive frequency that maximizes the production rate by:

generating an inflow performance relationship comprising pump intake pressure versus the production rate, based on a static pressure at the surface pump and a productivity index;

determining a production relationship between the production rate and the jet pressure based on the jet relationship;

determining a frequency variation of the production rate with the drive frequency based on the production relationship;

identifying a production based optimum drive frequency at a maximum production rate of the frequency variation; and changing the pumping of the power fluid by driving the surface pump at the production based optimum drive frequency.

22. The jet pump method of claim 21, further comprising applying the inflow performance relationship to the production relationship between the pump intake pressure and the jet pressure of the jet pump.

23. The jet pump method of claim 22, wherein the changing of the speed or torque of the surface pump further comprises determining the optimum drive frequency that minimizes the pump intake pressure by:

determining an intake variation of the pump intake pressure with the jet pressure;

determining a frequency variation of the pump intake pressure with the drive frequency based on the intake variation;

identifying an intake based optimum drive frequency at a minimum of the pump intake pressure of the frequency variation;

comparing the production based optimum drive frequency with the intake based optimum drive frequency; and further changing the pumping of the power fluid by driving the surface pump at one of the intake based optimum drive frequency, and combinations drive frequency and the intake based optimum drive frequency.

24. The jet pump method of claim 23, wherein the changing of the speed or torque of the surface pump further comprises detecting a stability period when the pumping parameters remain within a predetermined range for at least a minimum duration.

25. The jet pump method of claim 15, wherein the changing of the speed or torque of the surface pump comprises:

generating the jet pressure of the jet pump based on the measured pumping parameters and jet parameters of the jet pump;

generating a relationship between the jet pressure and a drive frequency;

detecting a stability period when the measured pumping parameters remain within a predetermined range for at least a minimum duration;

determining an intake variation of a jet pump intake pressure with the jet pressure;

determining a frequency variation of the jet pump intake pressure with the drive frequency based on the intake variation; and identifying an optimum drive frequency at a minimum pump intake pressure of the frequency variation.

* * * * *